US008671637B2

(12) United States Patent
LeBlang

(10) Patent No.: US 8,671,637 B2
(45) Date of Patent: Mar. 18, 2014

(54) STRUCTURAL INSULATING CORE FOR CONCRETE WALLS AND FLOORS

(76) Inventor: Dennis William LeBlang, Palm Desert, CA (US)

( * ) Notice: Subject to any disclaimer, the term of this patent is extended or adjusted under 35 U.S.C. 154(b) by 0 days.

(21) Appl. No.: 13/400,103

(22) Filed: Feb. 19, 2012

(65) Prior Publication Data

US 2012/0144767 A1 Jun. 14, 2012

Related U.S. Application Data

(63) Continuation-in-part of application No. 12/456,707, filed on Jun. 22, 2009, now Pat. No. 8,161,699, and a continuation-in-part of application No. 12/231,875, filed on Sep. 8, 2008, now Pat. No. 8,176,696.

(51) Int. Cl.
*E04C 1/42* (2006.01)

(52) U.S. Cl.
USPC ..... 52/309.12; 52/252; 52/309.4

(58) Field of Classification Search
USPC ..... 52/251, 252, 309.12, 309.4, 309.7, 52/309.9, 309.13–309.17, 258, 259, 260
See application file for complete search history.

(56) References Cited

U.S. PATENT DOCUMENTS

| | | | | |
|---|---|---|---|---|
| 4,602,467 | A | 7/1986 | Schilger | |
| 4,909,007 | A | 3/1990 | Bodner | |
| 4,930,278 | A | 6/1990 | Staresina | |
| 5,138,813 | A | 8/1992 | Cooney | |
| 5,279,088 | A | 1/1994 | Heydon | |
| 5,335,472 | A | 8/1994 | Phillips | |
| 5,353,560 | A | 10/1994 | Heydon | |
| 5,381,635 | A * | 1/1995 | Sanger | 52/251 |
| 5,505,031 | A | 4/1996 | Heydon | |
| 5,526,629 | A | 6/1996 | Cavaness | |
| 5,722,198 | A | 3/1998 | Bader | |
| 5,758,463 | A | 6/1998 | Mancini | |
| 5,943,775 | A | 8/1999 | Lanahan | |
| 6,041,561 | A | 3/2000 | LeBlang | |
| 6,044,603 | A | 4/2000 | Bader | |
| 6,125,608 | A | 10/2000 | Charlson | |
| 6,151,858 | A | 11/2000 | Ruiz | |
| 6,167,624 | B1 | 1/2001 | Lanahan | |
| 6,438,918 | B2 | 8/2002 | Moore | |
| 6,481,178 | B2 | 11/2002 | Moore | |
| 6,519,904 | B1 | 2/2003 | Phillips | |
| 6,681,539 | B2 | 1/2004 | Yost | |
| 6,708,459 | B2 | 3/2004 | Bodnar | |
| 6,729,094 | B1 | 5/2004 | Spencer | |
| 6,817,151 | B2 | 11/2004 | Foderberg | |
| 6,837,013 | B2 | 1/2005 | Foderberg | |
| 6,988,347 | B2 | 1/2006 | Nanaykkara | |
| 7,028,439 | B2 | 4/2006 | Foderberg | |
| 7,278,244 | B1 | 10/2007 | Rubin | |
| 7,308,778 | B2 | 12/2007 | Nanaykkara | |
| 7,395,999 | B2 | 7/2008 | Walpole | |
| 7,681,368 | B1 * | 3/2010 | Rubio | 52/309.12 |
| 7,908,807 | B2 * | 3/2011 | Geilen | 52/309.12 |
| 2004/0068948 | A1 * | 4/2004 | Wrass | 52/309.7 |

* cited by examiner

*Primary Examiner* — Jeanette E Chapman
*Assistant Examiner* — Daniel Kenny

(57) ABSTRACT

A concrete wall mold formed with a structural insulating core of horizontally and vertically integrated spacer blocks with tongue and groove connections between framing members having connectors attached to the framing members and embedded into the concrete surface. The spacer blocks having additional support molds to reinforce the concrete surface by means of adding rib, column, beam molds or drainage channels and recess grooves. The concrete surface may be located above or below the concrete wall mold.

8 Claims, 15 Drawing Sheets

STRUCTURAL INSULATING CORE FOR CONCRETE WALLS AND FLOORS

REFERENCE TO RELATED APPLICATIONS

This application is a continuation-in-part of patent application Ser. No. 12/456,707 filed Jun. 22, 2009 now U.S. Pat. No. 8,161,699 and Ser. No. 12/231,875 filed on Sep. 8, 2008 now U.S. Pat. No. 8,176,696.

FEDERALLY SPONSORED RESEARCH OR DEVELOPMENT

Not Applicable.

PARTIES OR JOINT RESEARCH

Not Applicable.

FIELD OF THE INVENTION

A concrete wall mold having an insulated foam core of foam spacers that interlock vertically and horizontally with tongue and groove connections between framing members having connectors embedded into the concrete facing. Additional drainage channels, recessed grooves, rib molds, column molds or beam molds can be formed within the foam spacers for additional strength or bonding between the concrete facing and the foam spacers whether concrete in installed above or below the foam spacers prior to being erected in a vertical position.

BACKGROUND OF THE INVENTION

A precast concrete wall is very difficult to insulated, that is rigid insulation can only be installed in the middle of a precast wall. When a concrete beam or column is installed within the wall, there is no insulation in the wall unless the precast wall has furring strips and insulation installed at the interior wall surface.

Thin faced precast concrete wall panels have been using light gauge metal framing for the structural backing for a few years now. When the concrete is poured face up, insulation supports the concrete until it has cured, while pouring the concrete face down in a forming bed, the light gauge metal framing is suspended over the forming bed and the metal channel is typically embedded into the concrete facing and usually no thermal break is accomplished. These systems do not combine the wall and sheathing insulation, plus have that thermal break as well as the flexibility to install columns and beams within the structure.

Different types of closed cell insulations can be used as a part of thin faced precast concrete wall panels, that is polystyrene, aerated autoclave concrete, cellular light weight concrete or light weight concrete with foam pellets. All of these materials are not load bearing materials, but are good insulation materials and some materials can withstand exterior weather conditions and some cannot without having to install an exterior coating. Some of the materials can have grooves or projections installed prior to pouring concrete, that is depending if the precast if formed face-up or face-down.

Smaller size of foam spacers can be assembled together to form larger assembled wall panels into which concrete is then poured. The foam spacers have overlapping tongue and groove connections both vertically and horizontally interlocking metal channels into the foam spacers.

The horizontal bracing channels within the wall forming structure is generally provided by installing bridging members which tie the support channels together. These bridging members may be attached on the outside of the flanges of the support channels or maybe internal bridging members installed through openings provided in the web of the support channels. None of the bridging members used today have a limited function and do not provide a solution for interacting with rigid insulation between support channels and the holes the internal bridging members pass through.

DESCRIPTION OF PRIOR ART

A. Concrete Column & Beam Using Metal Channels

In U.S. Pat. No. 6,041,561 & U.S. Pat. No. 6,401,417 by LeBlang shows how a concrete column and beam can be installed within a wall using metal channels and rigid insulation/hard board or as a column and beam within a wall.

B. Precast Concrete Thin Panel Poured Face Down

Precast concrete panels when poured face down have the metal framing installed when the concrete face is being poured and other patents the metal framing is installed after the concrete has cured. None of the patents have a framing system in conjunction with a rigid insulation core.

Most of the precast panel poured face down have the metal framing embedded into the concrete like Schilger in U.S. Pat. No. 4,602,467, Bodnar in U.S. Pat. No. 4,909,007 & U.S. Pat. No. 6,708,459, Staresina in U.S. Pat. No. 4,930,278, Cavaness in U.S. Pat. No. 5,526,629, Ruiz in U.S. Pat. No. 6,151,858. In the 3 patents by Foderberg U.S. Pat. No. 6,817,151, U.S. Pat. No. 6,837,013 & U.S. Pat. No. 7,028,439 the hat channel is secured to the metal channel and one is separated by a thermal break at the flange. The Nanaykkara U.S. Pat. No. 6,988,347 & U.S. Pat. No. 7,308,778 both are cast face down however in U.S. Pat. No. 7,308,778 has insulation between the two precast panels. In Rubio at U.S. Pat. No. 7,278,244 uses a bracket which is attached to the metal channel. In Cooney U.S. Pat. No. 5,138,813 has a bracket that is inserted and then fastened to the metal channels.

C. Precast Concrete Thin Panel Poured Face Up

The concrete panels poured face up have the metal channels embedded into concrete or poured concrete over rigid insulation with a connector attached. Precast concrete panels when poured face up; typically have the metal framing installed when the concrete face is being poured.

The patent by Mancini U.S. Pat. No. 5,758,463 and LeBlang U.S. Pat. No. 6,041,561 both showing the metal channels embedded into the concrete and patents by LeBlang U.S. Pat. No. 6,041,561 and Spencer U.S. Pat. No. 6,729,094 showed a connector attached to the metal channel and rigid insulation sheathing.

D. Precast Concrete Wall with Exposed Insulation

In Moore U.S. Pat. No. 6,438,918 & U.S. Pat. No. 6,481,178 use an ICF as a form and a precast concrete facing is attached to the ICF. In U.S. Pat. No. 6,681,539 (filed Oct. 24, 2001) by Yost uses metal channels, insulation and ties to pour a precast wall.

E. Foam Panel

In U.S. Pat. No. 5,943,775 (filed Jan. 7, 1998) and U.S. Pat. No. 6,167,624 (filed Nov. 3, 1999) by Lanahan uses a polymeric foam panel with metal channels installed within the foam. The panels are interlocked together by a tongue and groove connection using the foam as the connector. An electrical conduit is horizontally installed within the panel for electrical distribution. The metal channels are embedded within the foam. None of the Lanahan patents use their panels to form concrete columns or beams. Walpole in U.S. Pat. No.

7,395,999 embeds a metal channel in foam for support and uses a tongue & groove joint sealer between panels. In U.S. Pat. No. 5,722,198 (filed Oct. 7, 1994) and U.S. Pat. No. 6,044,603 (filed Feb. 27, 1998) by Bader discloses a panel & method to form a metal channel and foam panel where the flanges are embedded into the sides of the foam panels. In U.S. Pat. No. 5,279,088 (filed Jan. 17, 1992), U.S. Pat. No. 5,353,560 (filed Jun. 12, 1992) and U.S. Pat. No. 5,505,031 (filed May 4, 1994) by Heydon show a wall and panel structures using overlapping foam and metal channels in various configurations.

F. Foam Tape on Studs

Foam tape is shown on metal and wood channels to reduce the conductivity between different building materials.

In U.S. Pat. No. 6,125,608 (filed Apr. 7, 1998) by Charlson shows an insulation material applied to the flange of an interior support of a building wall construction. The claims are very broad since insulating materials have been applied over interior forming structures for many years. The foam tape uses an adhesive to secure the tape to the interior building wall supports.

G. No Relationship to Invention—Appeared Significant

In U.S. Pat. No. 5,335,472 (filed Nov. 30, 1992) & U.S. Pat. No. 6,519,904 (filed Dec. 1, 2000) by Phillips initially developed a patent where a concrete wall is formed by pneumatically applying concrete to a foam panel with a wire mesh layer. A concrete column is pneumatically applied in the U.S. Pat. No. 5,335,472 and a vertically poured concrete column in the second patent using metal channels, a forming plate and pneumatically placed concrete wall as the concrete form. None of the Phillips patents relate to the pending patent.

SUMMARY OF THE INVENTION

A wall mold for bonding concrete to a structural insulating core of horizontal and vertical interlocking tongue and groove spacer blocks (shown using foam spacers or spacer insulation) between support channels with concrete bonded to the spacer blocks, connectors and support channels. The spacer blocks can have indentations and recesses to form many other molds by using columns, ribs, beams, projections, and recesses that add strength or molds that drain water from between the concrete and spacer blocks. The spacer blocks can cover the flanges of the support channels or just protrude beyond the support channels to form a thermal break.

Another variation of the invention is the flexibility of the spacer blocks to be wider than the support channels to overlap the flanges of the support channels in various different ways. The spacer blocks interlock vertically with a tongue and groove connections between the support channels. When the spacer blocks are wider than the support channels a portion of the spacer block or projection extends over the flange of the support channels. The projections of a spacer block can be longer than the flange of the support channels and a recess is formed on the adjacent spacer block providing a better joint connection between spacer blocks. The projections on the spacer blocks can be located on the groove side of the spacer blocks or on the tongue side of the spacer block allowing the tongue to fit between the lips and flange of the support channels. Horizontal bracing channels can also be inserted through the holes of the support channels allowing mechanical items to pass through the holes in the support channels.

Another variation of the invention is when the concrete wall panel needs to be a larger size, the support members need to be stronger and deeper to reduce the bending stress on the concrete when being erected. For example, vertical and horizontal rib molds may be added as headers and cripple supports for doors and windows. In addition, beam or column molds within the spacer blocks may be installed to increase the strength of the concrete of the wall panel. The larger column and beam molds can be installed in the foam spacers to support additional vertical and horizontal dead and live loads exerted on the concrete wall panels. Beams and columns are cut into the structural insulating core and laid horizontally into a forming bead where concrete is poured over or under the structural insulating core. When the concrete on the wall panel is thinner, the drainage channels that protrude from the spacer blocks or the recessed grooves that indent the spacer blocks may be used to increase the strength of the wall panel. Both of the drainage channels or recessed grooves can also create an air space to allow water to drain from behind the concrete or be used as architectural accents depending on the thickness of the concrete.

BRIEF DESCRIPTION OF THE DRAWINGS

FIG. 43A 72A shows a partial view of an ICF mold with a V groove in the rigid board of an ICF mold with a triangular connector end.

DESCRIPTION OF THE PREFERRED EMBODIMENTS

Figure 1:
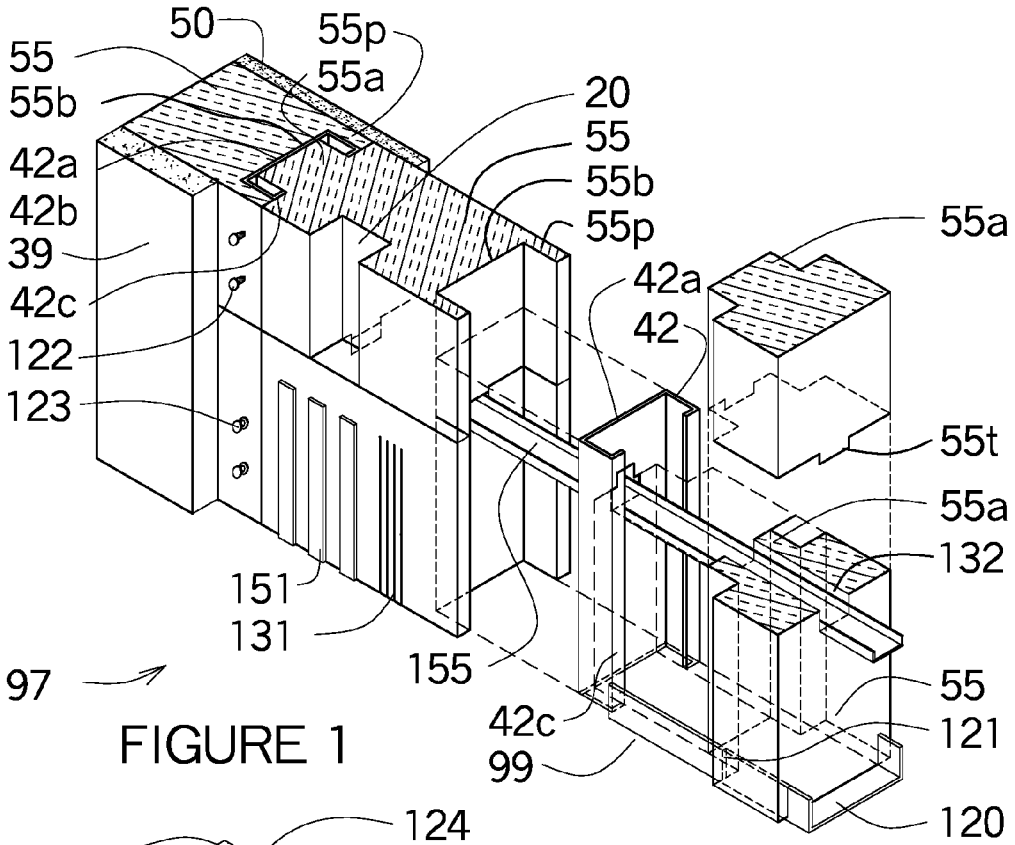
FIG. 1 shows an isometric view of a concrete wall mold with the concrete facing with connectors on the structural insulating core of interlocking tongue and groove foam spacers, framing members, horizontal bracing channels along with the drainage channels, recessed grooves, ribs and column mold.
Figure 16:
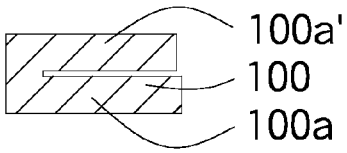
FIG. 16 shows the insulating foam separated from the flange of a double flange channel or U channel.
Figure 17:
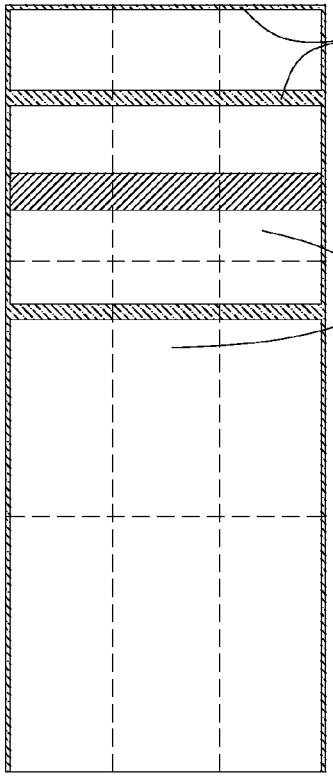
FIG. 17 shows a front elevation of a concrete wall with grooves and recesses.
Figure 18:
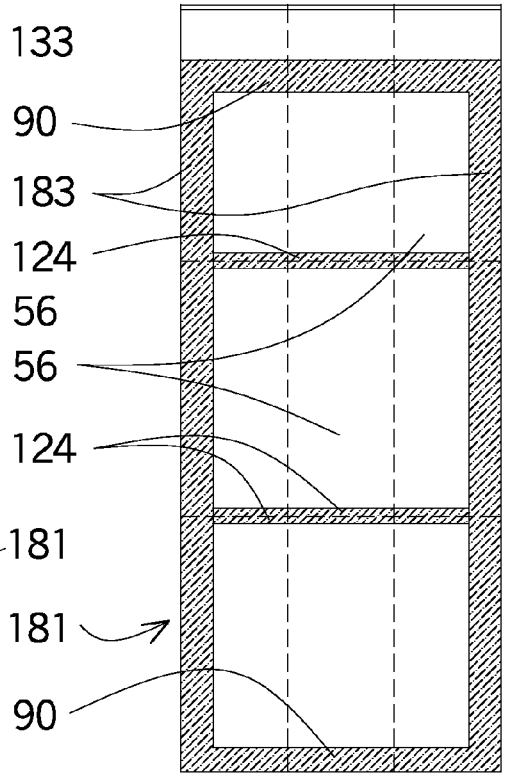
FIG. 18 shows the rear elevation of a concrete wall with the concrete columns and beams.

FIG. 1 shows an isometric view a wall mold 97 with the structural insulating core 111 shown in a vertical position, however the wall mold 97 is built in a horizontal position and erected vertically after concrete 39 is install. The support channels in the structural insulating core 111 are shown as C channels 42 and foam spacers 55 fit between the C channels 42. The left side shows the wall assembled and the right side shows the various wall components separated. The right side shows the support channel as a C channel 42 with the horizontal bracing channel 150 shown as a horizontal U channel 155 passing through the hole 36 in the web 42*a* of the C channel 42. On both sides of the C channel 42 are foam spacers 55 that have a trough 132 at the top of each foam spacers 55. The horizontal U channel 155 fits through the hole 36 and into the troughs 132 of the foam spacers 55. Another foam spacers 55 is shown above the horizontal U channel 155 where a horizontal tongue 55*t* fits into the trough 132 of the foam spacers 55. The trough 132 is deeper than the horizontal U channel 155 so to allow space for any mechanical/electric utilities to pass through. All the foam spacers 55 are shown deeper than the length of the web 42*a* of the support channel so projection 55*p* can extend over the flanges 42*b* of the C channel 42. The foam spacers 55 have a tongue shape 55*a* that fits between the lips 42*c* and abut the webs 42*a* and the lip 42*c* of the C channels 42 and a groove shape 55*b* where the groove shape abuts the web 42*a* of the C channel 42 and the projections 55*p* of the foam spacers 55 extends over the flanges 42*b* of the C channel 42 abutting the adjacent foam spacers 55. The base plate 120 is shown also as a horizontal U channel, however the web 155*a* is secured to a floor after the wall panel 65 is complete. When the wall mold 97 is being assembled, the webs 155*b* are attached to the flanges 42*b* of the C channel 42 and the flanges 42*b* also slide into a groove 121 at the bottom of the foam spacers 55. The left side of FIG. 1 shows the wall panel 65 completed with the structural insulating core 111 assembled together with the screws 122 or double headed fasteners 123 embedded into the concrete 39 installed over the structural insulating core 111 and a rigid board 50 installed after the wall panel 65 is erected vertically. Also installed in the structural insulating core 111 is a column mold 20 which is explained further in FIG. 3. Also shown are drainage channels 151 that protrude from the structural insulating core 111 to create an air space should the structural insulating core 111 be the exterior surface finish materials (not shown) are applied over the structural insulating core 111 and concrete 39 is the exposed surface on the interior. In addition, drainage channels 151 are shown on the exterior face of the structural insulating core 111 to allow water drainage between the structural insulating core 111 and various stucco applications. The recessed grooves 131 and drainage channels 151 can also be accents at the exterior face of the structural insulating core as shown in FIGS. 16 & 17. The base plate 120 shown as a horizontal U channel can be used as part of the wall mold 97, but is not necessary when forming a beam mold 90 as shown in some later figures.

Figure 2:
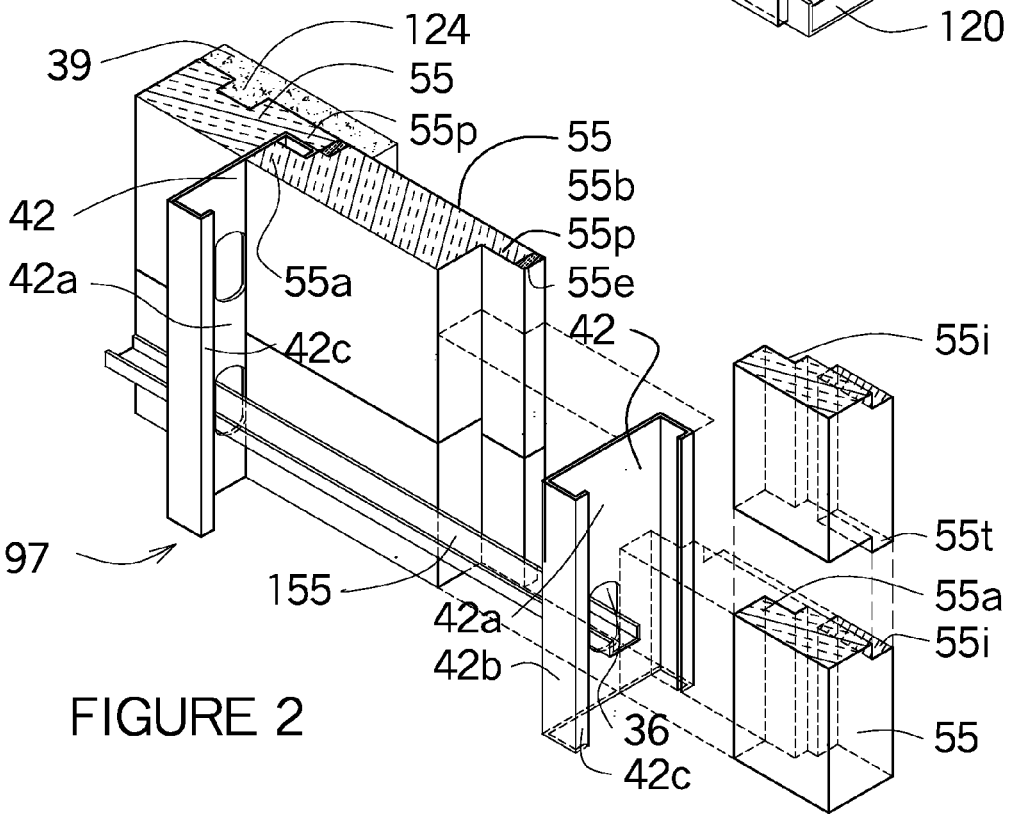
FIG. 2 shows an isometric view of a concrete partial wall mold and the tongue and groove connection between the foam spacers.
Figure 5:
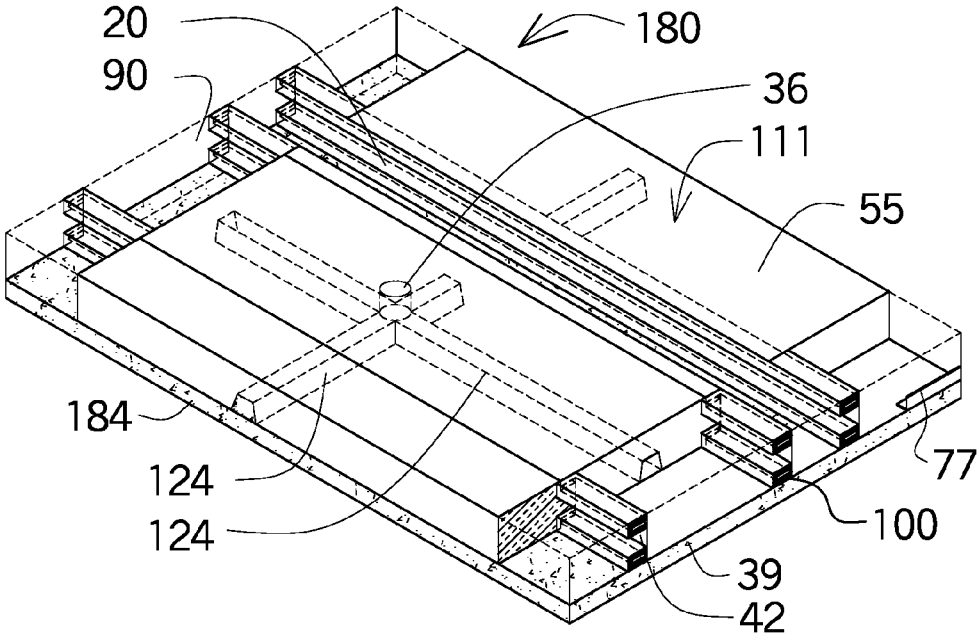
FIG. 5 shows an isometric view of a concrete mold where the concrete is below the structural insulating core.
Figure 6:
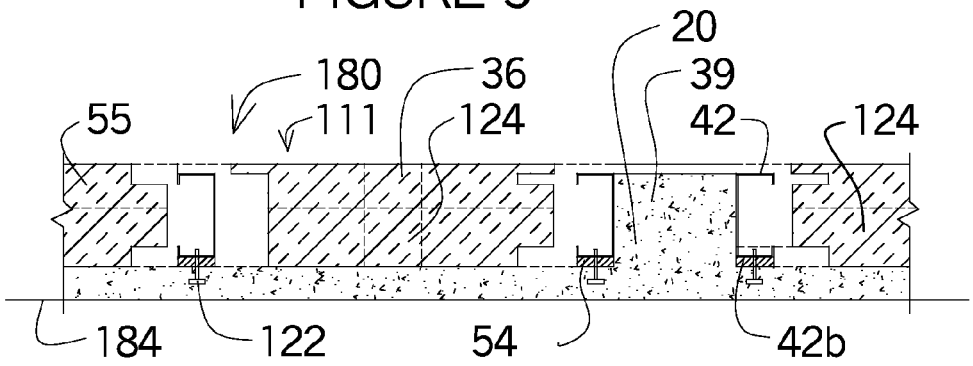
FIG. 6 shows a wall section of the concrete mold shown in FIG. 5.
Figure 7:
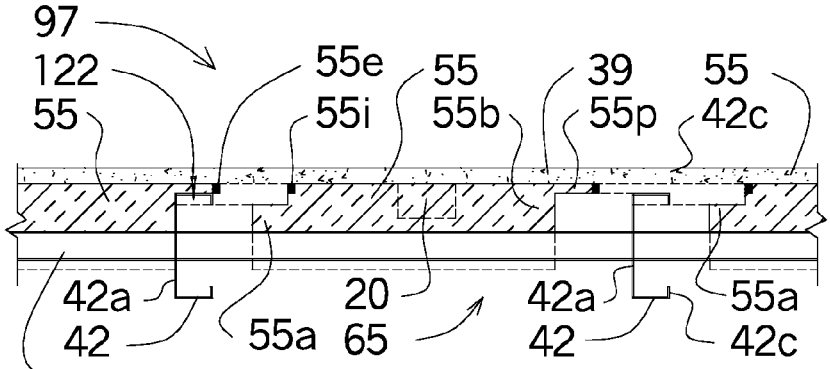
FIG. 7 is a wall section view of FIG. 2 with the concrete poured over the structural insulating core.

FIG. 2 is similar to FIG. 1 except the four foam spacers 55 spacer blocks 56 of the structural insulating core 111 does not extend over both flanges, the thickness of the foam spacers is thinner and varies in thickness as shown in FIGS. 5-9. The groove shape 55*b* of the foam spacers 55 has a projection 55*p* and extension 55*e* that extends beyond the webs 42*a* of the adjoining C channels 42 enough to create a thermal break and cover the C channels 42. The open portion of the C channel 42 has a web 42*a* and a lip 42*c* where the tongue shape 55*a* fits against and between and a horizontal bracing channel shown as a horizontal U channel 155 (typically used to connect adjacent C channels within the building industry) and an indentation 55*i* where the extension 55*e* fits against. FIG. 2 is similar to FIG. 1 since the isometric view a wall mold 97 is shown in a vertical position, however the wall mold 97 is built in a horizontal position and erected vertically after concrete 39 is install. Since the foam spacers 55 overlaps the C channel 42 at the projection 55*p* and fits between the webs 42*a*, the foam spacers 55, the foam spacers 55 is a wall insulation as well as a support for pouring concrete 39 onto the structural insulating core. FIG. 2 also shows a rib mold 124 in the foam spacer 55 with the concrete 39 poured over the structural insulating core 111 when in a horizontal position. The vertical connection between the foam spacers 55 has a horizontal tongue 55*t* the width of the projection 55*p* and extends downward into the indentation 55*i* of the foam spacers 55 when the foam spacers 55 are narrow. FIG. 7 shows the support channels exposed and FIGS. 8 & 9 the support channels are encased in concrete 39.

Figure 3:
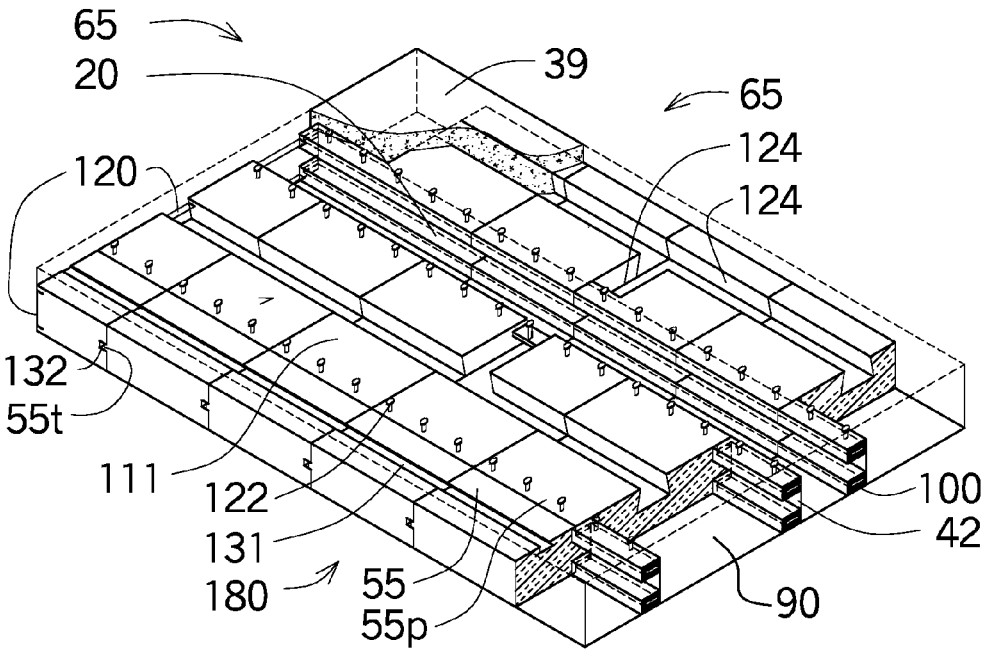
FIG. 3 shows an isometric view of a concrete mold with the concrete over the structural insulating core.
Figure 4:
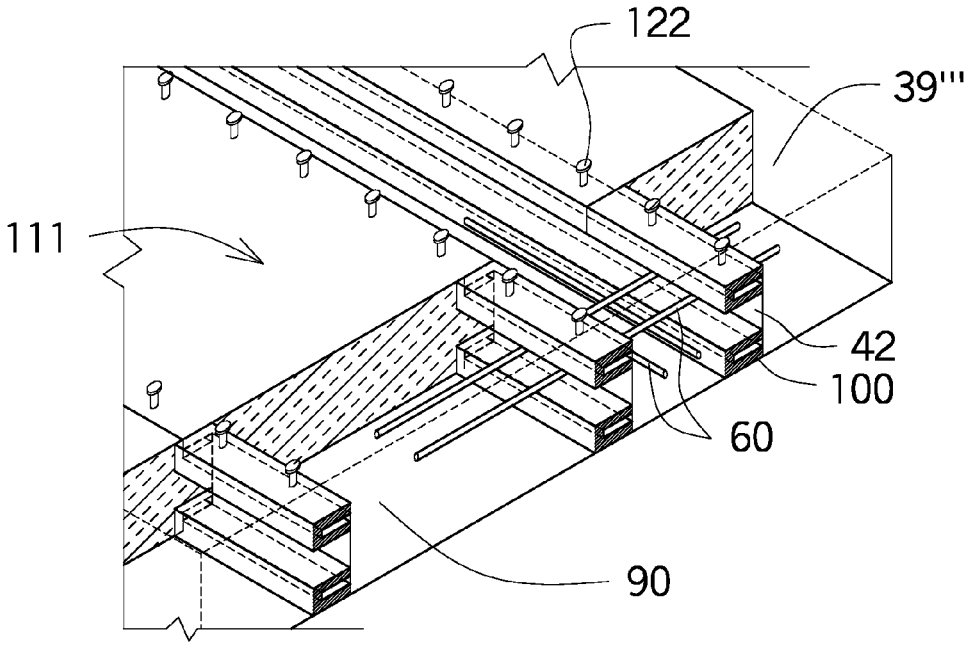
FIG. 4 shows an enlarged view of the concrete beam shown in FIG. 3.

FIGS. 3-6 uses structural insulating cores 111 from FIG. 1 with foam spacers that overlap both of the flanges 42*b* of the C channel 42. The wall panel 65 shown in FIG. 3 is shown horizontally where the floor 175 is the bottom of the precast mold 180 and the support channels shown as C channel 42 have foam spacers between them. One end of the precast mold 180 shows a base plate 120 shown as a horizontal U channel attached directly to the C channels 42 as shown in FIG. 1. In addition, the foam spacers can be smaller where each foam spacer has a horizontal tongue 55*t* fitting into the trough 132 from another foam spacer. A column mold 20 is shown with C channels on both sides and the C channels 42 extend into the beam mold 90. The base plate 120 can also be installed connecting the C channels 42 together. The foam spacers are part of the precast wall mold 180 and do not extend into the beam mold. The C channels 42 within the beam mold 90 are shown with insulating foam 100 fitting over the flanges 42*b* and lip 42*c* of the C channel 42 so drywall (not shown) or other materials can be attached after the concrete 39 has cured. In addition, ribs 124 are installed parallel to the C channel 42 and another rib 124 is installed perpendicular to the C channel 42 in the foam spacers 55 for additional strength if required. Screws 122 or double headed fasteners 123 are attached through the structural insulating core 111 into the C channel 42 to secure the structural insulating core 111 to the concrete. The precast mold 180 is complete when the form side boards (not shown) are installed. Additional steel reinforcing (not shown) is installed in the beam molds 90 and the column mold 20 and concrete 39 is poured over and into the precast mold 180 when the precast mold 180 is in a horizontal position. Since the concrete 39 passes through the holes 36 (not shown) in the C channel 42 of the beam mold 90, the C channel 42 is secured within the wall mold 180. When the ribs 124 and recessed grooves 131 are added to the precast mold 180, the screws 122 securing the concrete 39 to the structural insulating core 111 might not be needed. The rigid insulation 51 shown in FIG. 1 can be used as the bottom of the precast mold 180 or a forming bed, typically used in precast construction can be used. In addition a recessed groove 131 is installed to additionally secure the structural insulating core to the concrete. FIG. 4 is an enlarged view of the beam mold 90.

Figure 14:
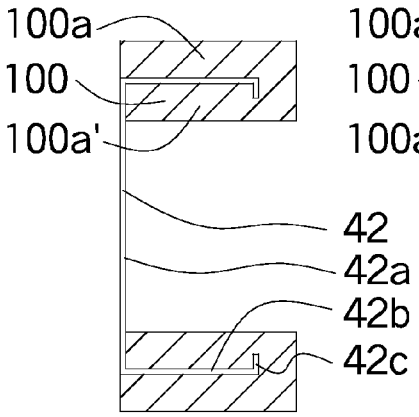
FIG. 14 is a section through a C channel where insulating foam is installed over the flange of the support channel.
Figure 15:
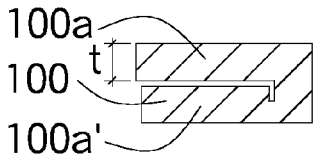
FIG. 15 shows the insulating foam separated from the flange of the support channels.

FIG. 5 is showing an isometric view of the same precast mold 180 as shown in FIG. 3 except the precast mold 180 is shown face down and FIG. 6 is the wall section of FIG. 5. The precast mold 180 is turned upside down so that the precast mold 180 is now placed onto a forming bed 184 and the structural insulating core 111 is suspended over the forming bed 184 so the flange 42*b* is set to the depth of the concrete 39 of the precast mold 180. In FIGS. 14-16 show the foam material 54 that can be used for C channels 42 or U channels 41. The foam material 54 is not necessary unless an additional material is going to be attached to the concrete 39. Holes 36 are cut into the structural insulating core 111 at the criss-crossing ribs 124 to ensure concrete 39 flows into the ribs 124. Another way to form the precast mold 180 is to install the insulating foam 100 on each of the C channels 42 along with the screws 122 and install an angle 77 connecting each C channel 42 to the desire shape of the precast mold 180. Now set the precast mold 180 over the forming bed 184 and pour the concrete 39 into the forming bed 184, beam mold 90 and into the column mold 20. After the concrete has become firm, then add the remaining foam spacer 55 to complete the structural insulating core 111. The edge forming boards of the precast mold 180 are shown in (ghost).

FIG. 7 is similar to the wall panel 65 in FIG. 2 except support channels shown as C channels 42 are horizontally on the floor 175 or forming bed 184. The precast mold 180 is above the C channels 42 since the projection 55*p* rest on the flange 42*b* of the C channels 42 and the remainder of the foam spacers 55 rest on the horizontal bracing channel 155 spanning between the support channels. The beam mold 90, column mold 20 or any ribs 124 (not shown) are on the same surface as the projection 55*p* and the screws 122 are attached through the projection 55*p* of the foam spacer. The concrete mold 180 is complete when steel reinforcing 60 (not shown) and concrete can then be installed over the precast mold 180. After the concrete 39 has cured, the concrete mold 90 can be tilted vertically into place. On the other hand, the precast mold 180 as described above can be assemble in place or as a precast mold and hoisted into place to become a floor 175 rather than a precast wall. Depending on the insulation requirements, the foam spacers 55 can be deeper as shown dotted in FIG. 7.

Figure 8:
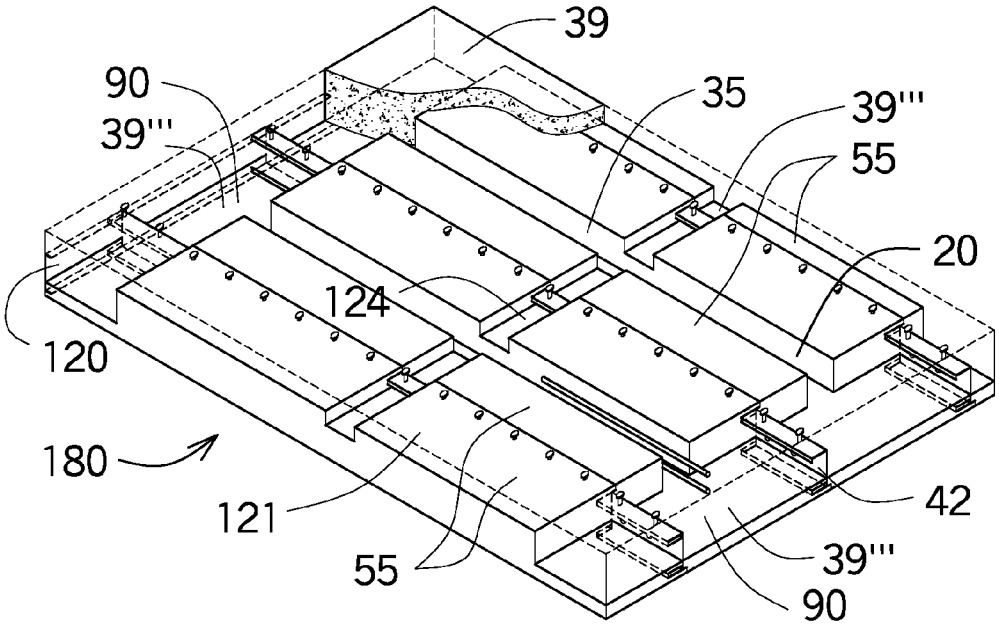
FIG. 8 is an isometric view of a concrete mold where concrete is pour over the structural insulating core and the support channels are separate from the concrete columns within the wall mold.
Figure 9:
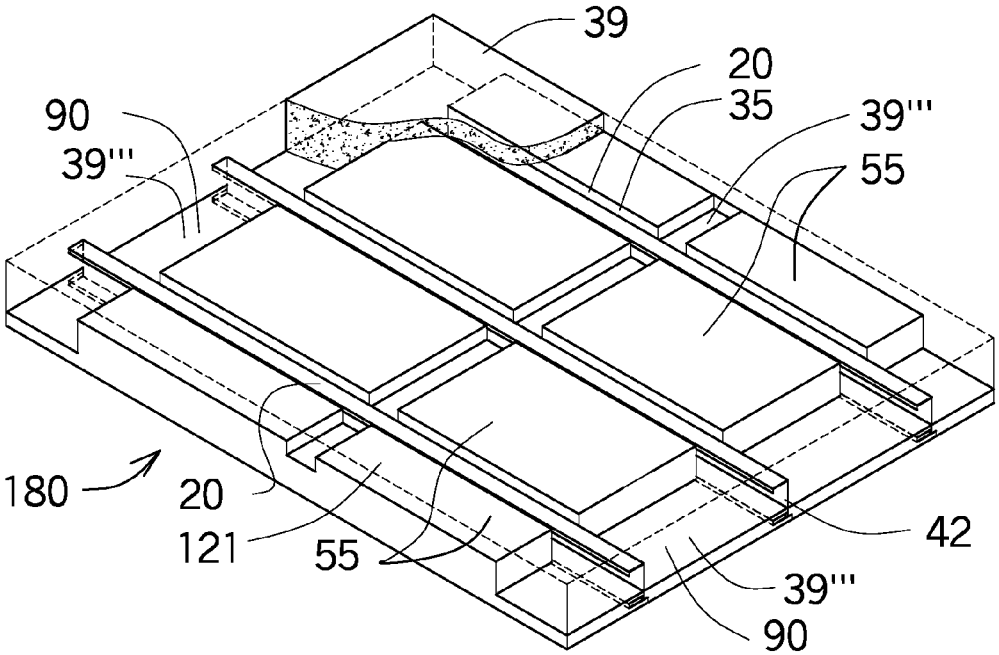
FIG. 9 is an isometric view of a concrete mold where the support channels have one flange within the foam spacers and the remainder of the support channels is embedded within the concrete beam.

FIGS. 8 & 9 are combinations of FIGS. 1 & 2 shown in a horizontal position. In FIG. 8 the foam spacers 55 are wider than the C channel 42 and the projections 55*p* overlap both flanges 42*b* of the C channels 42. Screws are secured through the projections 55*p* with extensions 55*e* into the flange 42*b* of the top flange 42*b*. Two column molds 20 are shown cut into the foam spacers 55 to the required depth and additional ribs 124 are shown crossing the column molds 20 and extending parallel to the column molds 20. The beams molds 90 are shown at the top and bottom of the precast mold 180 similar to the profile shown in FIG. 2, however one of the beam molds 90 in FIG. 8 shows a base plate 120 connecting the C channels 42. Screws 122 are connected through the projections 55*p* or directly into the flanges 42*b*. After steel reinforcing 60 is added to the columns 20 and beams 90 concrete 39 can now be installed.

In FIG. 9 the foam spacers uses the interlocking tongue and groove connection at the tongue side 55*a* and the groove side 55*b* at the C channels 42 at the bottom of the precast mold 180. The foam spacers at the column mold 20 do not touch the C channel 42 but the foam spacers form the edge of the column mold 20. Since the C channel 42 is exposed not screws 122 are needed. The beam mold 90 is formed the same way as the column mold 20 with the interlocking tongue and grooves of the foam spacers 55. After steel reinforcing 60 is installed within the precast mold 180, concrete 39 is poured over the structural insulating core 111.

Figure 10:
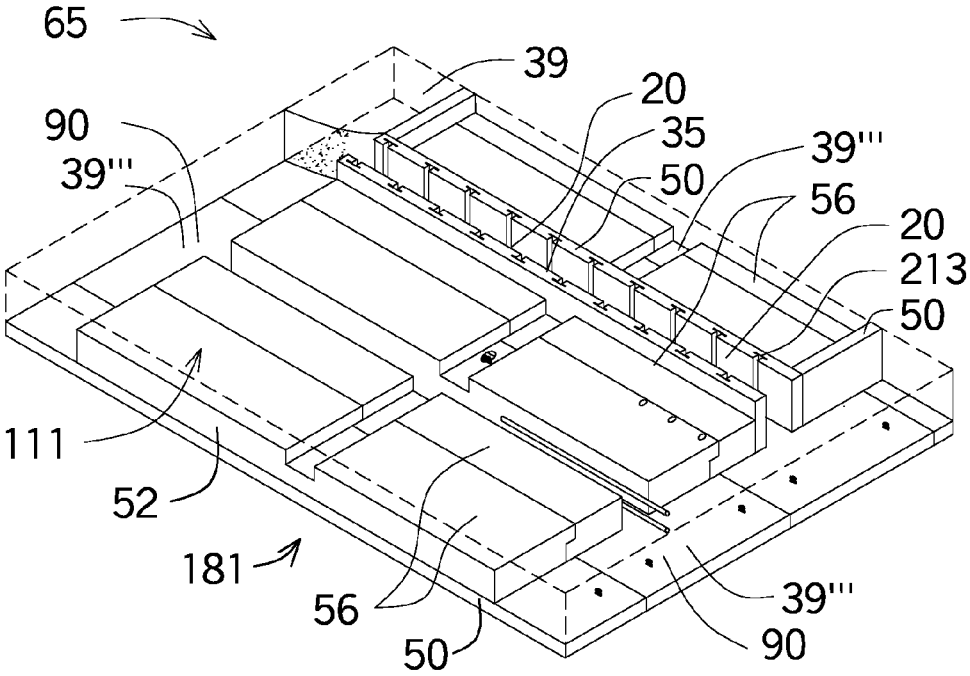
FIG. 10 is an isometric view of the concrete mold where no support channels are used and the column mold extends above the structural insulating core.
Figure 11:
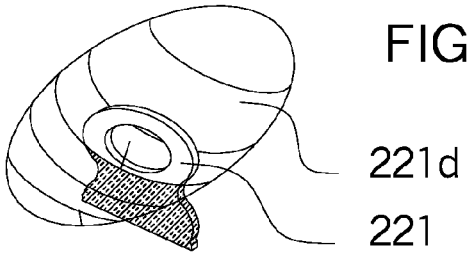
FIG. 11 is an isometric view of a lift connector embedded into the structural insulating core.
Figure 12:
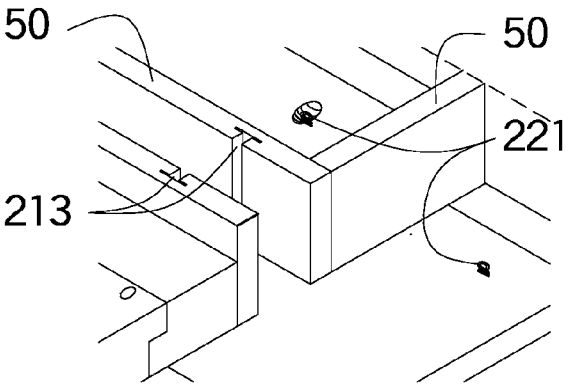
FIG. 12 shows an enlarged isometric view of the column mold extending above the structural insulating core.

FIG. 10 is very similar to FIGS. 8 & 9 except no support channels or the C channels 42 are used since the foam spacers 55 or the concrete 39 will be left unfinished. If the foam spacers are a material like aerated autoclaved concrete (AAC) or cellular light weight concrete (CLC), lift connectors 221 can be embedded into either material and concrete 39 can adhere to the foam spacers 55. One of the column molds 20 also shown in FIG. 12 has a rigid board 50 extending above the foam spacers 55 on both sides of the column mold 20 with dovetail joints 213 to fit a connector 64 (not shown) into to maintain the spacing of the column mold 20.

Figure 13:
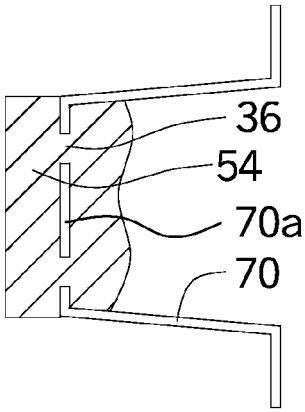
FIG. 13 shows foam material installed into the holes of the hat channel.

FIG. 13 shows a cross-section of the insulating foam 100 installed on a hat channel 86. The foam material 54 can be installed by applying holes 36 on the face 70*a* of the hat channel 70 and then applying the foam material 54 into the holes 36 and then further removing the residual with a hot knife (not shown). The foam material 54 shown here has a thermal break at the flat edge of the foam material 54 and can be used on any metal channel needed a thermal break.

In FIG. 14 shows a cross section of a C channel 42 with different insulating foam 100 wrapped around the flange 42*b* of the C channel 42. The insulating foam 100 has a thickness t which is constant as it wraps around the flange 42*b*. The C channel 42 also has a lip 42*c* at the end of the flange 42*b*. The insulating foam 100 extends the length of the flange 42*b* shown as 100*a*, then around the lip 42*c* over the back side of the flange 42*b* shown as 100*a*' and stops at the web 42*a*. The lip 42*c* and the friction of the flange 42*b* allow the insulating foam 100 to adhere to the C channel 42. The insulating foam 100 is shown in FIG. 15 and in FIG. 16 for a straight flange connection like a U channel 41.

FIG. 15 shows the front elevation of a wall panel 65 and FIG. 16 shows the rear of the same wall panel 65. An isometric view of the rear view of a similar wall panel 65 is shown in FIG. 10. Since a wall panel 65 can be at least 10 feet wide by 35 feet tall, smaller aerated autoclave concrete sections of the foam spacers 55 can be used to form the beam molds 90 and column molds 20 are formed to complete the wall mold 181. In FIGS. 3, 8 & 9 concrete 39 is poured over the various wall molds, however when the concrete 39 is eliminated and the foam spacers 55 is exposed, ribs 124 are required at the joints between the foam spacers 55 wall sections. The front elevation shown in FIG. 15 has various architectural reliefs shown in FIG. 1 as a protruding drainage channel 151 or a recessed groove 133. The architectural reliefs can be installed in the aerated concrete prior to autoclaving when the aerated concrete is soft and can be cut by wire or pressed into the desired shape or can be cut after autoclaving by cutting with a saw or by hot wire cutting.

Figure 19:
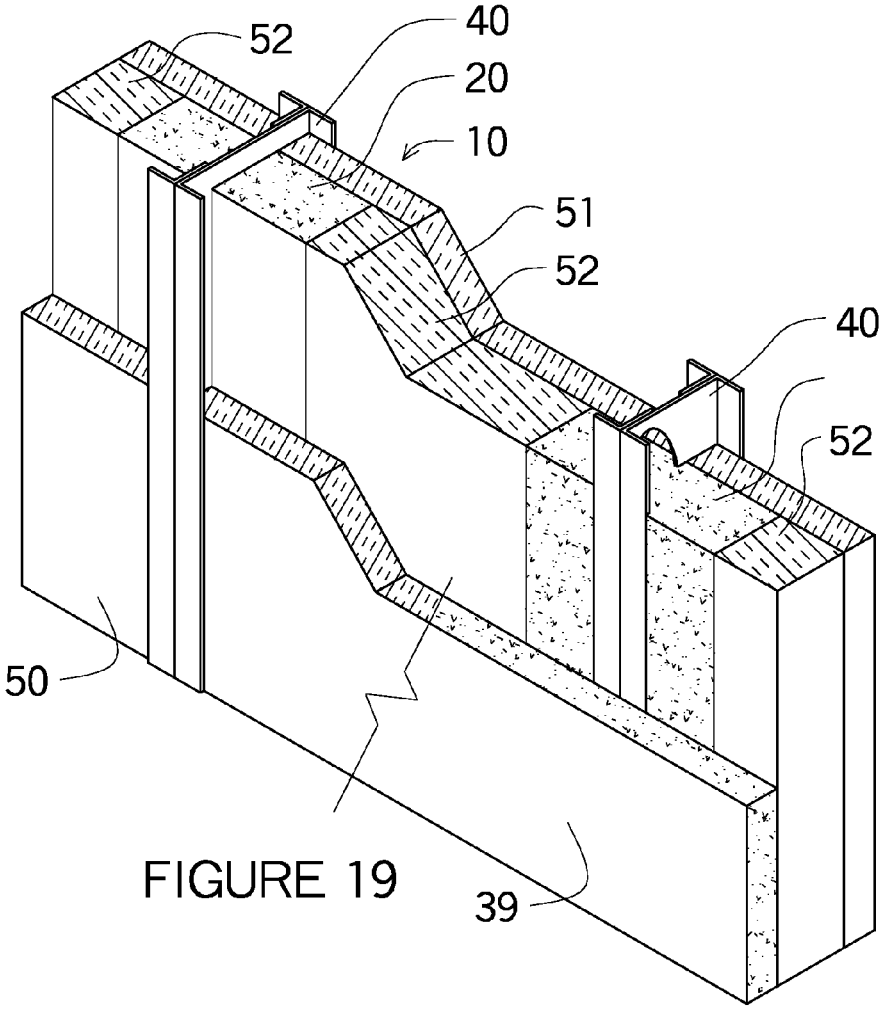
FIG. 19 is an isometric view of a column in a building wall using a wall mold structure in the middle of the column.
Figure 20:
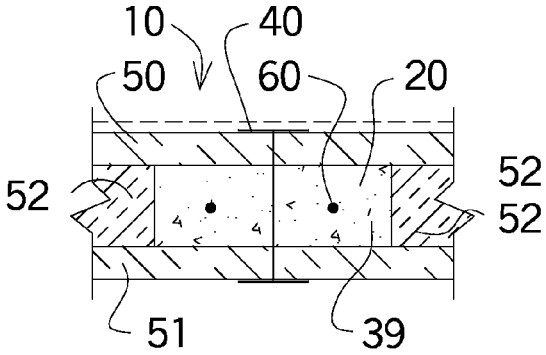
FIG. 20 shows a plan view of a column within the building wall straddling the wall forming mold.
Figure 21:
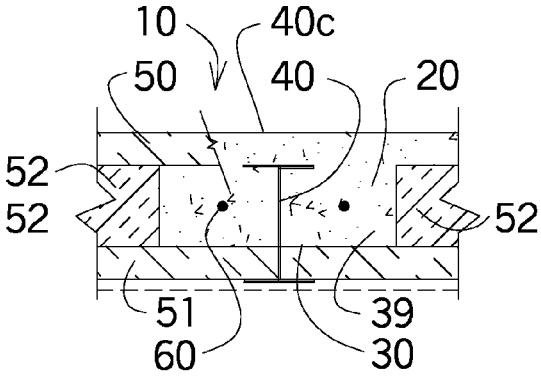
FIG. 21 shows a plan view of a column within the building wall partially embedded with the wall forming mold.

In FIG. 19 a wall mold 10 is shown in isometric view with two different configurations of column molds 20. The wall mold 10 consists of a rigid board 50 and rigid insulation 51 are the inner and outer rigid boards that define the outer surfaces of the wall mold 10. The interior of the column molds 20 & 21 are also shown in a plan view drawing in FIG. 20 and FIG. 21. The width of the column mold 20 are determined by the thickness of the spacer insulation 52 located between the rigid board 50 and the rigid insulation 51. On the other hand, the width of the column molds 20 is the distance between the spacer insulation 52. In FIG. 20 the support channel of the column forming structure is an H channel 40 shown at the middle of the column mold 20 extending outside of the wall mold 10 but yet an integral part of the column mold 20 securing both the rigid board 50 and the rigid insulation 51 to the wall mold 10. In FIG. 21 the H channel 40 is smaller than in FIG. 20 which allows the rigid insulation 51 to be secured to the outer surface of flange 40*c* of the H channel 40. The opposite flange 40*c*' of H channel 40 is secured on the interior surface of the flange 40*c*' making it easier to fasten another material (shown in ghost) to the H channel 40. Since no fastening means is shown connecting the spacer insulation 52 to either the rigid board 50 and rigid insulation 51, the material has to be compatible so an adhesive (not shown) can connect the various materials together. The depth of the column molds 20 are determined by the structural strength of the adhesive and the bending stress of the rigid board 50 and rigid insulation 51. On the other hand, the rigid board 50, rigid insulation 51 and the spacer insulation 52 could all be formed of the same material and secured together with the H channel 40. Steel reinforcing 60 can be added prior to the column molds 20 being filled with a hardenable material. Should the wall mold 10 be used as a precast mold 180 then the rigid board 50 or rigid insulation 51 would be removed prior to installing concrete 39 into the mold.

Figure 22:
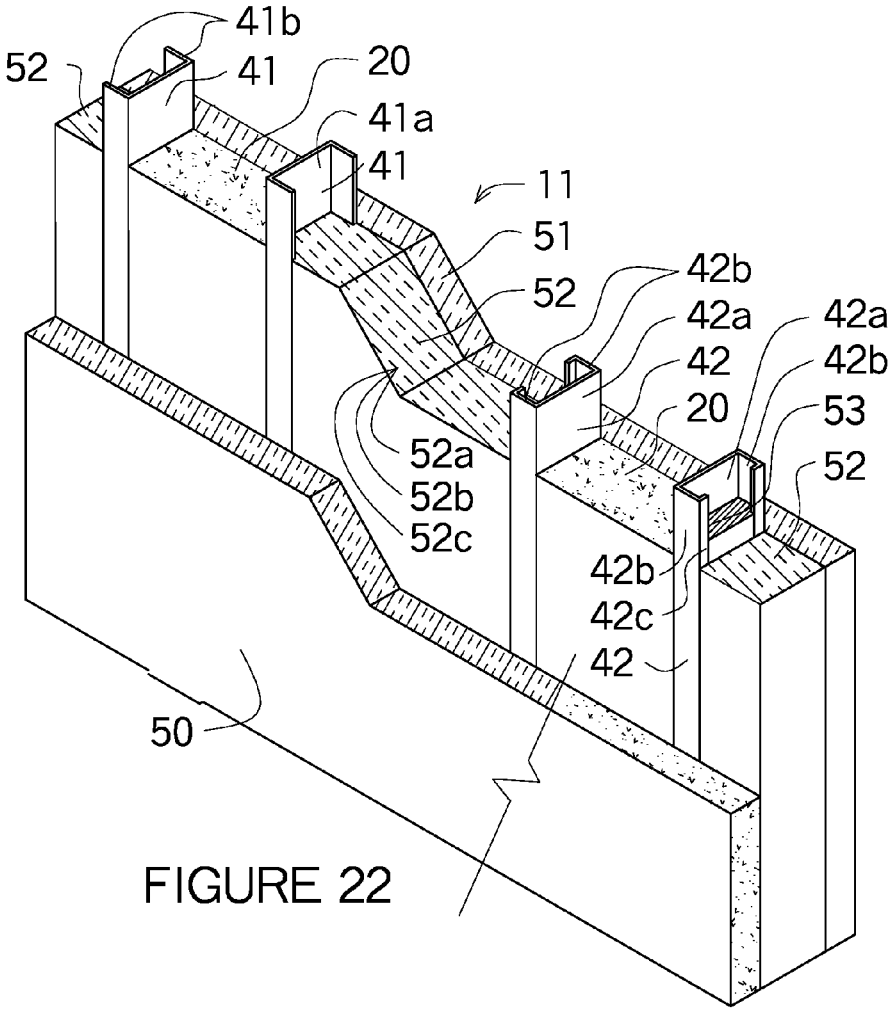
FIG. 22 is an isometric view of a wall column using two U or C channels to help support the column mold.
Figure 23:
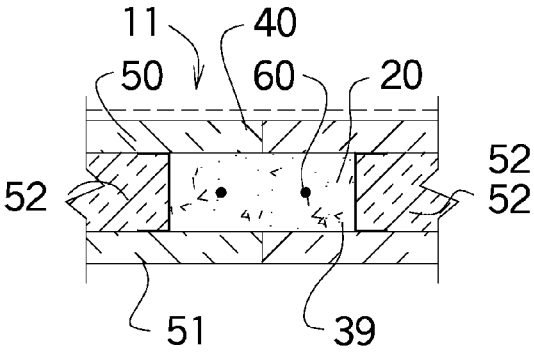
FIG. 23 is a plan view showing the U channels supporting the wall mold.
Figure 24:
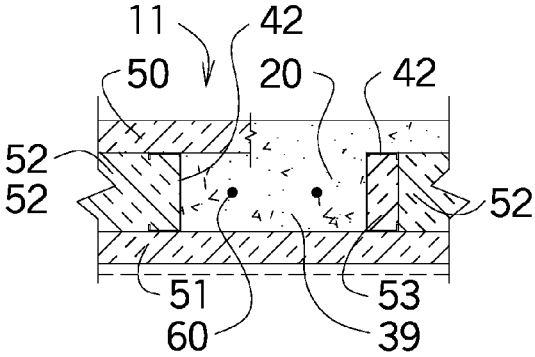
FIG. 24 is a plan view showing the C channels supporting the wall mold.

In FIGS. 22-24 a wall mold 11 is shown in isometric view with two column molds 20. The wall mold 11 consists of a rigid board 50 and rigid insulation 51 as the outer surfaces of wall mold 11 along with the spacer insulation 52 between the outer surfaces. The column forming structure within the column mold 20 shown in FIGS. 22 & 23 consists of two support channels shown as U channels 41. The flanges 41*b* are secured to the rigid board 50 and the rigid insulation 51 along with the spacer insulation 52. The spacer insulation 52 fits securely between the web 41*a* of each U channel 41. The space between the web 41*a* of the U channel 41 define the depth of the column mold 20. In FIG. 24 the column mold 20 uses support channels shown as C channels 42 to function in a similar capacity as the U channels 41 in FIG. 23. The C channels 42 in FIG. 24 have a lip 42*c* to give the column mold 20 additional strength. As like FIG. 23 the web 42*a* the C channels 42 define the width of the column mold 20. The C channel 42 is shown with rigid foam 53 at the interior of the C channel 42. The rigid foam 53 is secured within the C channel 42 by the two flanges 42*b* and the web 42*a* and the lip 42*c*. The rigid foam 53 eliminates any air infiltration that could occur within the C channel 42. Since the wall mold 11 has the U channels 41 or the C channels 42 as part of the column mold 20, the spacer insulation 52 can be installed as part of the wall mold 11 or the spacer insulation 52 can be installed after the wall mold 11 has been installed in a vertical position. When the spacer insulation 52 is a solid material the spacer insulation 52 can be fabricated as part of the wall mold 11 and prior to erecting the wall mold 11. On the other hand if the spacer insulation 52 is not installed prior to the wall mold 11 being erected, a loose granular insulation material 52*a* can be poured into the area occupied by the spacer insulation 52 through the top of the wall mold 11. In addition, in lieu of a loose granular insulation 52*a*, a dry cellulose fiber insulation 52*b* or a liquid foam 52*c* can also be filled from the top of the wall mold 11. Typically the spacer insulation 52 is a rigid foam type material, however new products are being developed like hybrid natural-fiber composite panel with cellular skeleton tubular openings which can function the same as a rigid foam material. Should the wall mold 11 be used as a precast mold 180 then the rigid board 50 or rigid insulation 51 would be removed prior to installing concrete 39 into the mold and the foam material 53 can be installed into the C channel.

Figure 25:
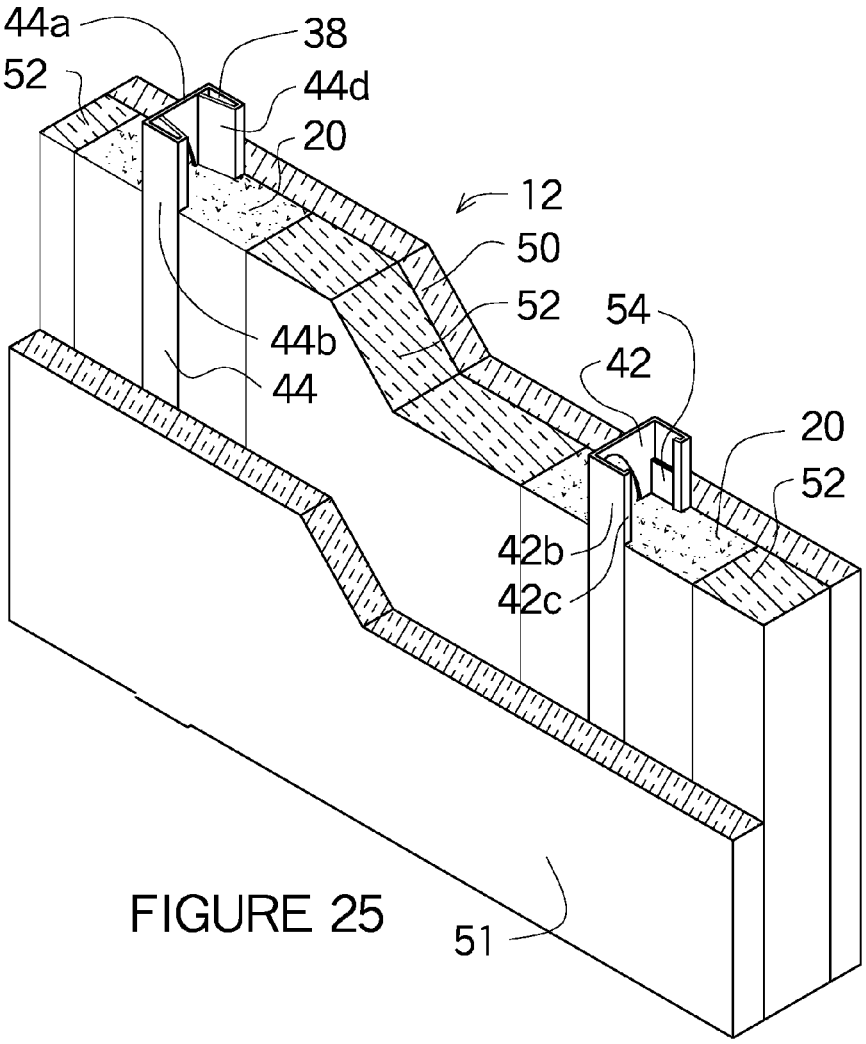
FIG. 25 is an isometric view of two columns one using a bent flange channel at the support channel of the column mold and the other column a C channel.
Figure 26:
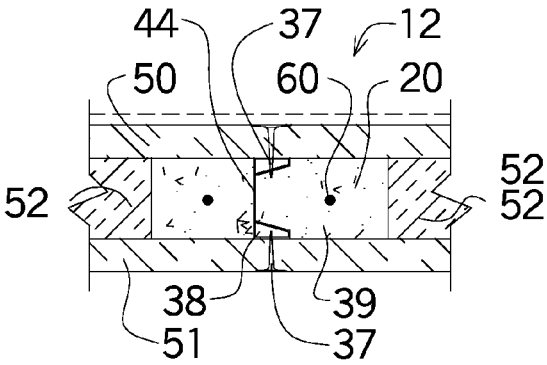
FIG. 26 is a plan view showing the bent flange channel at the center of the column forming structure.
Figure 27:
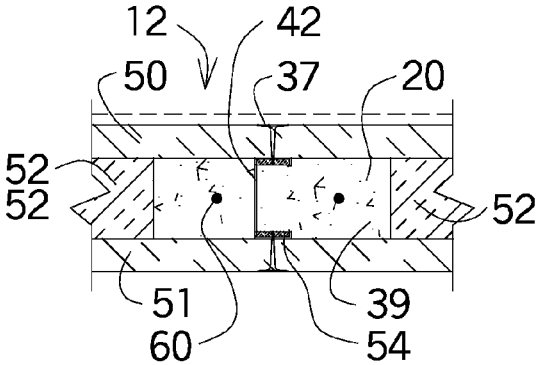
FIG. 27 is a plan view showing a C channels with insulation material at the flange.

In FIGS. 25-27 a wall mold 12 is shown in isometric view with two column molds 20. The wall mold 12 consists of a rigid board 50 and rigid insulation 51 as the outer surfaces of wall mold 12 along with the spacer insulation 52 between the outer surfaces. The distance between the spacer insulations 52 define the width of column mold 20. The plan view in FIG. 26 shows a bent flange channel 44 as the column forming structure and is located in the middle of column mold 20. The bent flange channel 44 has a web 44*a* which is the same width as the spacer insulation 52. The bent flanges consist of two parts, that is, 44*b* is adjacent to the rigid insulation 51 and the remainder of the bent flange 44*d* is bent again to be close to the web 44*a*. The double bending of flange 44*b* & 44*d* allows a fastener 37 to secure the bent flange channel 44 at two spots that is the flange 44*b* and 44*d*. Light gauge metal say 25 gauge is not very strong, and the double flanges 44*b* and 44*d* allow two surfaces into which a fastener 37 can attach to and thereby increasing the strength a fastener 37 can attached to support the rigid board 50 as well as resist the force of wet concrete 39 pushing against the rigid board 50. When the wall mold 12 is erected vertically the steel reinforcing 60 is added and the column mold 20 is filled with concrete 39. Upon doing so the web 44*a* and the bent flanges 44*b* & 44*d* create a cavity 38. Between the lip 42*c* and the web 42*a* and adjacent to the flanges 42*b* a foam material 54 can be installed. Should the wall mold 12 be used as a precast mold 180 then the rigid board 50 or rigid insulation 51 would be removed prior to installing concrete 39 into the mold and the foam material 54 can be installed into the C channel.

Figures 28, 29, 30:
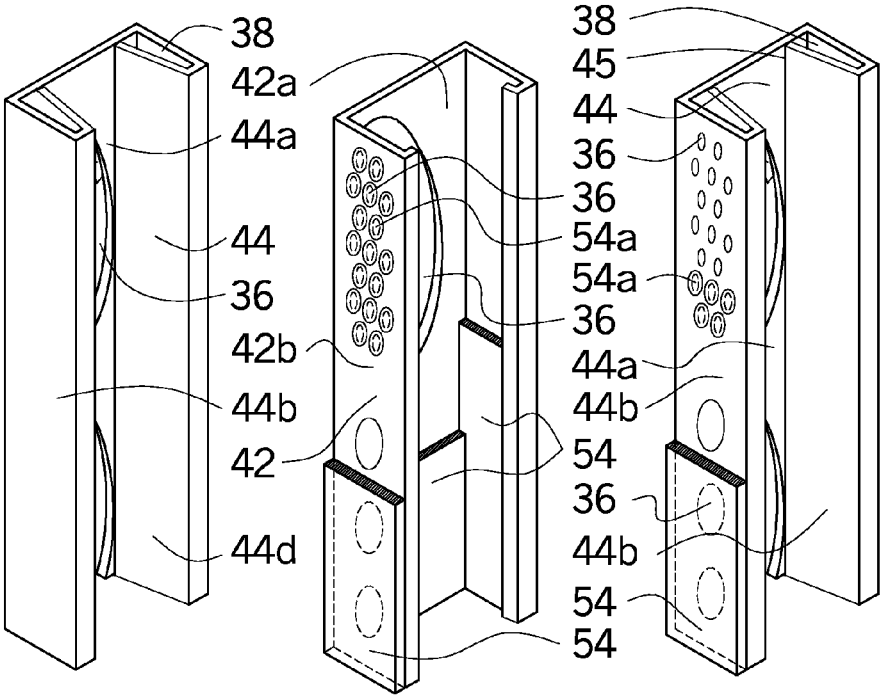
FIG. 28 is an isometric view of the bent flange channel.
FIG. 29 is an isometric view of a forming structure showing the foam material attached to the interior flange of the forming structure.
FIG. 30 is an isometric view of a bent flange channel with holes for use as part of the wall forming structure.
Figure 32:
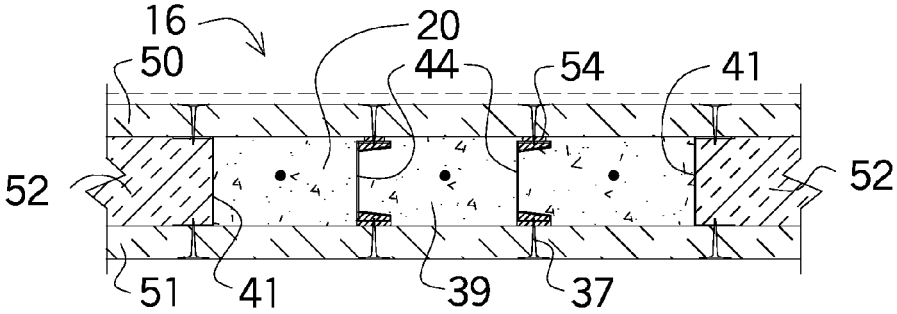
FIG. 32 is a plan view of an elongated column forming structure using two intermediate forming structures with insulation at the outer surface and interior of the flanges.

FIGS. 28-30 are isometric views of several forming structures previously described. FIG. 28 shows an enlarged view of the bent flange channel 44. In FIG. 30 is the same bent flange channel 44 in FIG. 28, except the flange 44*b* also has holes 36. The holes 36 in the 44*b* flange are used to install foam material 54 into the holes 36 filling the cavity 38 and covering the flange 44*b* with foam material 54. If the foam material 54 is installed in a factory, the foam material 54 will first fill the cavity 38 and then the residual is then removed with a hot knife (not shown) to form a smooth plane parallel to the flange 44*b*. If the foam material 54 is installed at the construction site, the foam material 54 will be soft and when either the rigid board 50 or rigid insulation 51 is secured with fastener 37, the foam material 54 will be of sufficient thickness to separate the rigid board 50 or rigid insulation 51 from the bent flange channel 44 as shown in FIG. 32. Another way to install the foam material 54 is through the gap 45 between the web 44*a* and the bent flange 44*d*. When installing the foam material 54 through the gap 45, located between the bent flange 44*d* and the web 44*a*, the foam material 54 will first fill up the cavity 38 and then the excess will penetrate through the holes 36. Depending when the foam material 54 is applied, the foam material 54 excess will be cut (by a hot knife not shown) to form as smooth plane parallel to the flange 44*b*. FIG. 29 shows the same holes 36 at the flange 42*b* of the C channel 42. The holes 36 are shown with the foam material 54 passing through the holes 36. Depending on the amount of foam material 54 that has been installed through the holes 36, the foam material 54 shown on the flange 42*b* or 44*b* will form a bell shape 54*a* or the foam material 54 when smoothed will form a solid rectangular shape 54*b*. In FIG. 29 the foam material 54 is shown on the web 42*a* which is typically used around windows and doors for securing them to the web of the column forming structure like 42*a*. Should the wall mold 12 or 16 be used as a precast mold 180 then the rigid board 50 or rigid insulation 51 would be removed prior to installing concrete 39 into the mold and the foam material 54 can be installed into the C channel or the bent flange channel can be used.

Figure 31:
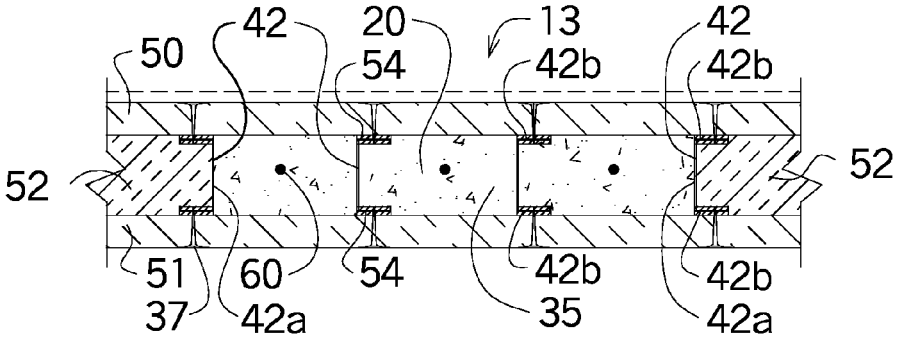
FIG. 31 is a plan view of an elongated column forming structure using two intermediate forming structures.

The FIG. 31-32 shows the wall molds 13 & 16 which consists of a rigid board 50 and rigid insulation 51 as the outer surfaces of the wall molds 13 & 16 along with the spacer insulation 52 between the outer surfaces. In FIG. 31 the column forming structure shown in column mold 20 consists of four support channels shown in FIG. 29. For clarity purposes, the two C channels 42 that are located in the middle of the column mold 20 are shown with the foam material 54 at the flanges 24*b* as shown in FIG. 29. The two C channels 24 shown at the spacer insulation 52 are also shown with the foam material 54*b*, however the foam material 54 can be eliminated if the spacer insulation 52 is cut slightly differently. The distance between the two webs 42*b* of the C channel 42 that encase the spacer insulation 52 is the total width of the column mold 20. The depth of column mold 20 is the distance between the outside surfaces of the foam material 54 of both flanges 42*b* more clearly shown in FIG. 29. The number of C channels 42 will vary depending size and structural requirements of the concrete column 35 and the steel reinforcing 60 required. FIG. 32 is similar to FIG. 31, except here the column forming structure consists of two support channels shown as bent flange channels 44 in the middle of the column mold 20 and two U channels 41 shown at the ends of column mold 20. Like in FIG. 31, the foam material 54 is adjacent to the bent flange channel 44 as well as the rigid board 50 and the rigid insulation 51. Any additional material (shown in ghost) may be attached with fasteners 37 after the concrete 39 has cured in either the column molds 20 because both the C channel 42 and the bent flange channel 44 have foam material 54 behind the flanges 42*b* & 44*b* of their respective channels. Should the wall mold 13 or 16 be used as a precast mold 180 then the rigid board 50 or rigid insulation 51 would be removed prior to installing concrete 39 into the mold and the foam material 54 can be installed into the C channel or the bent flange channel can be used.

Figure 33:
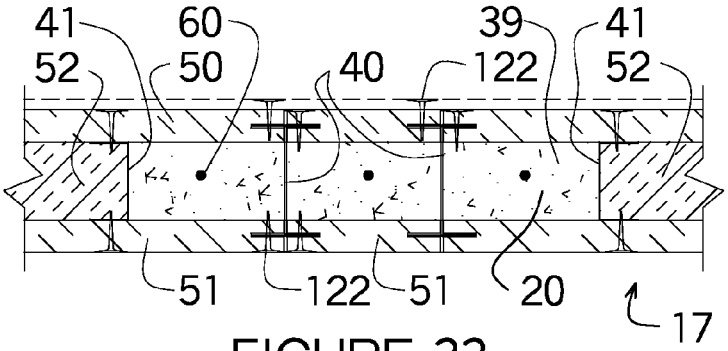
FIG. 33 is a plan view showing and elongated column with the column forming structure embedded within the exterior and interior wall mold structure.

FIG. 33 shows the wall mold 17 consists of a rigid board 50 and rigid insulation 51 as the outer surfaces of column mold 20 and the U channels 41 form the other sides of column mold 20. The flanges 40*b* of the H channel 40 are shown in the middle of the rigid board 50 and rigid insulation 51 as well as between the H channels 40. The rigid board 50 and rigid insulation 51 can each be attached to the H channel 40 by screws 122. Depending on the size of the column mold 20, additional H channels 40 along with additional rigid board 50 and rigid insulation 51' can be installed between the H channels 40 forming a longer column mold 20. Should the wall mold 17 be used as a precast mold 180 then the rigid board 50 or rigid insulation 51 would be removed prior to installing concrete 39 into the mold.

Figure 34:
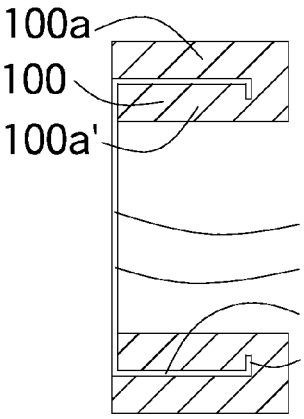
FIG. 34 shows a C channel with the foam material wrapped around the flange of the C channel.
Figure 35:
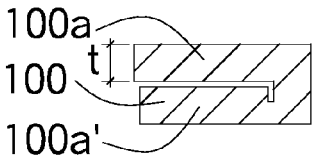
FIG. 35 shows the foam material configuration for the C channel.

In FIG. 34 shows a cross section of a C channel 42 with a different insulating foam 100 wrapped around the flange 42*b* of the C channel 42, and shown in FIGS. 28 & 29 as well as in some of the previous wall mold applications. The insulating foam 100 has a thickness t which is constant as it wraps around the flange 42*b*. The C channel 42 also has a lip 42*c* at the end of the flange 42*b*. The insulating foam 100 extends the length of the flange 42*b* shown as 100*a*, then around the lip 42*c* over the back side of the flange 42*b* shown as 100*a*' and stops at the web 42*a*. The lip 42*c* and the friction of the flange 42*b*, allows the insulating foam 100 to adhere to the C channel 42. The insulating foam 100 is shown in FIG. 35 after a hot knife (not shown) has cut the groove into the insulating foam 100 for the C channel 42 configuration.

Figure 37:
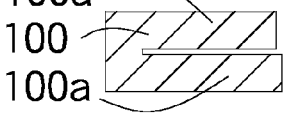
FIG. 37 shows the foam material configuration of the double flange channel.
Figure 36:
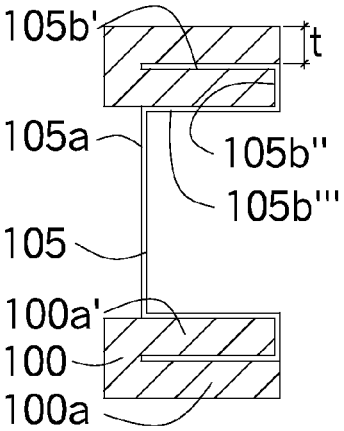
FIG. 36 shows a double flange channel with the foam material inserted into the double flange channel

FIG. 36 shows a double flange channel 105, which is another type of support channel to form column molds 20 and beam molds 90 that consist of a web 105*a* and two bent flanges 105*b*' & 105*b*''', one at each end of the web 105*a*. The bent flanges show an outer flange 105*b*', a turning flange 105*b*'', and a returning flange 105*b*'''; which are connected to the web 105*a* of the bent channel 105. The bent flanges allows a fastener (not shown) to be connected to two flanges, the outer flange 105*b*' and the inner flange 105*b*'''. These double flanges 105*b*' & 105*b*''' gives the fastener 37 (not shown) twice the strength to support the rigid board 50 or rigid insulation 51 from the pressure of the concrete 39 shown in any of the previously mention Figures. Also shown in FIG. 36 is insulating foam 100 that is wrapped around the bent flange 105*b*. The insulating foam 100 extends the length of the flange 105*b*''' shown as 100*a*, then around the turning flange 105'' over the back side of the returning flange 105*b*''' shown as 100*a*' and stops at the web 105*a*. The friction between the outer flange 105*b*' and the returning flange 105*b*''' is sufficient to hold the insulating foam 100 into place. The insulating foam 100 as shown in FIG. 37 can also be used on U channels or on H channels previously described.

Figure 38:
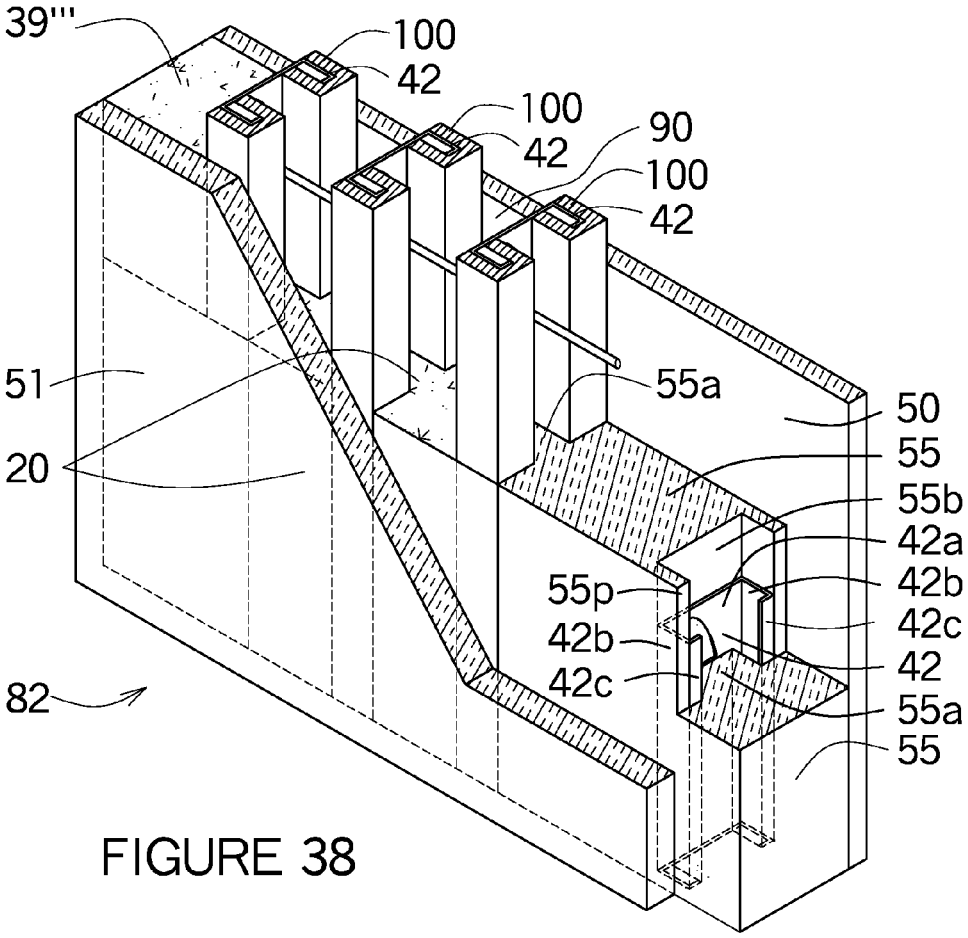
FIG. 38 shows an isometric drawing using a C channel as the wall forming structure.

FIG. 38 with C channels 42 with insulating foam 100 secured around the flange 42 and the lip 42*c* when the C channels extend into the beam mold 90 supported by rigid board 50 and rigid insulation 51. The insulating foam 100 slides around the lip 42*c* making the insulating foam 100 easier to install around the C channel 42. The insulating foam 100 is installed typically only where the beam mold 90 passes the C channel 42 within the wall mold 82. In addition the foam spacer 55 has a different tongue shape 55*a* and groove shape 55*b* configuration since the C channel 42 is used in FIG. 38. The foam spacer can be changed to fit any size or shape of support channels. Should the wall mold 82 be used as a precast mold 180 then the rigid board 50 or rigid insulation 51 would be removed prior to installing concrete 39 into the mold and insulating foam 100 can be installed within the column mold 20 and beam molds 90.

Figure 39:
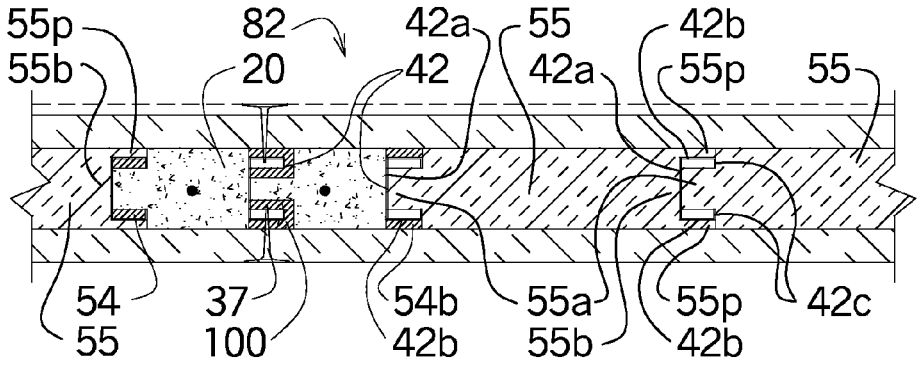
FIG. 39 shows a plan view of the C channel as the wall forming structure.

FIG. 39 shows a plan view of the wall mold 82 shown in FIG. 38. The insulation foam 100 is shown at the center C channel 42. The C channel 42 on the left side of the column mold 20 shows the foam spacer 55 over lapping the C channel 42 at the flange 42*b* at the groove shape 55*b* with a projection 55*p* extending the length of the flange 42*b*. A foam material 54 at the interior of the column mold 20 is connected at the flange 42*b* of the C channel 42. The left C channel 42 at the column mold 20 can be reversed as shown at the right C channel 42 of the column mold 20. The right C channel 42 of the column mold 20 is shown with foam material 54 at the flanges 42*b*. The foam material 54 can be incorporated as part of the foam spacer 55 as shown as the projection 55*p* of the groove shape 55*b*. The projection 55*p* and the groove shape 55*b* of the foam spacer 55 encases the outside face of the web 55*a* and the flanges 42*b* of the C channel 42 and the projection 55*p* extends to the lip 42*c*. The base plate 120 without the groves 121 shown in FIG. 1 can be installed over the projections 55*p* of the foam spacers into any of the support channels previously shown, creating a thermal break between them.

Figure 40:
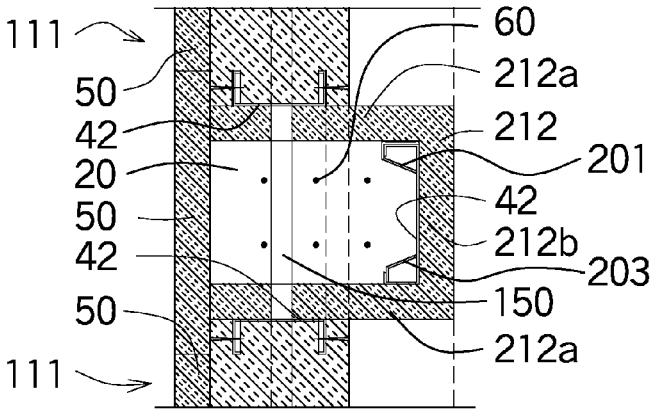
FIG. 40 shows a one piece column mold and exterior rigid insulation formed using a different rigid insulation than the spacer insulation of the structural insulating core.
Figure 44:
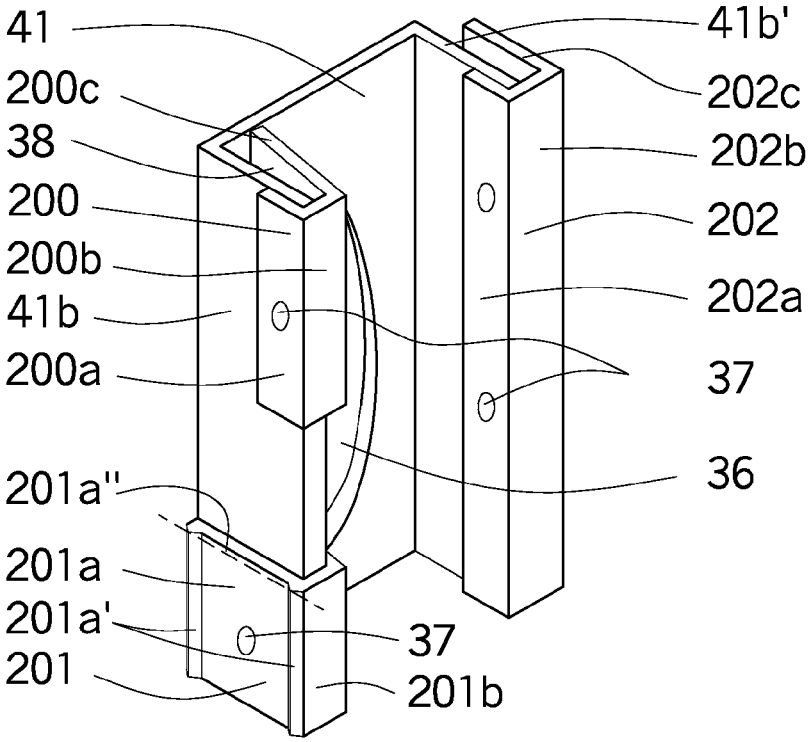
FIG. 44 shows a U channel with various flange extensions attached.
Figure 45:
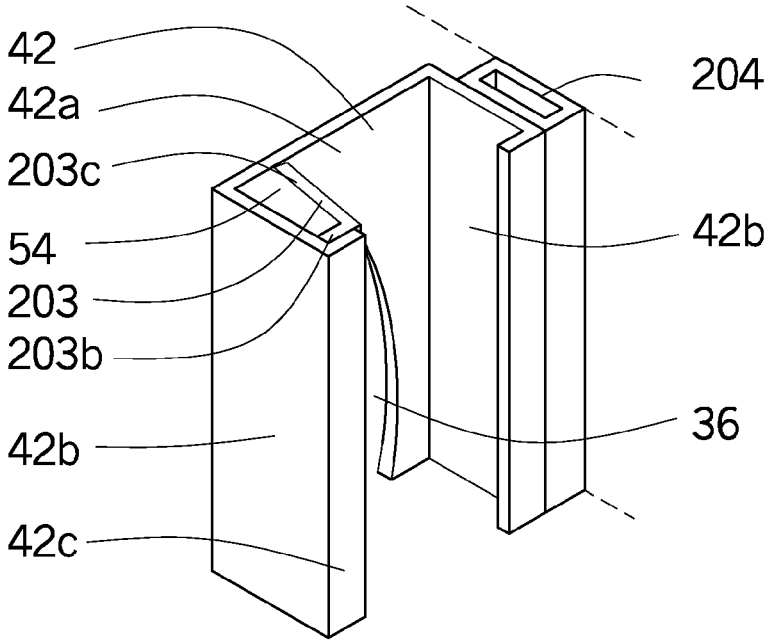
FIG. 45 shows a C channel with various flange extensions attached.

FIG. 40 is a plan view of a column mold 20 comprising of a rigid board 50 and a one piece mold 212 that is U shaped having two sides 212*a* and a back 212*b*. The sides 212*a* of the one piece mold 212 fits between the structural insulating cores 111 and is connected to the C channel 42 within the structural insulating cores 111. Another C channel 42 within the one piece column mold 212 is installed at the sides 212*a* and back 212*b* within the one piece mold 212 for additional strength. Additional flange extensions as shown in FIGS. 44 & 45 can be added to the C channel 42 within the one piece mold 212 for easy installation of additional wall materials like drywall (not shown). The one piece mold 212 can be a rigid material like polystyrene or aerated autoclave concrete. The same material shown in the one piece mold 212 is shown as a rigid board 50 installed over the structural insulating cores 111 as well as another rigid board 50 is shown as forming the fourth side of the one piece mold 212. The one piece mold and the rigid board 50 can all be connected to the C channels 42 within the structural insulating core 111 by fasteners 37 (not shown). A horizontal bracing channel 150 is shown passing through the one piece mold 212 between the structural insulating cores 111 on both sides of the one piece mold 212 and connected to the vertical reinforcing steel 60.

Figure 41:
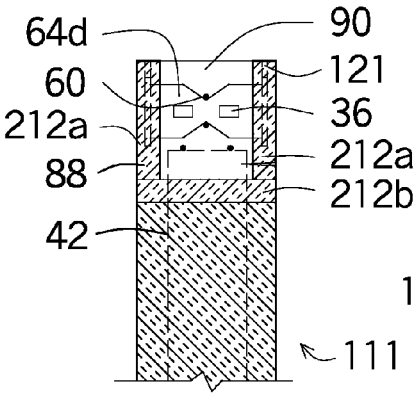
FIG. 41 shows a one piece beam mold with a structural insulating core below plus an ICF connector.

FIG. 41 shows a beam mold 90 that is above the structural insulating core 111. The beam mold 90 can be formed as a one piece mold 212 where the interior has been removed thus forming the two sides 212*a* and the bottom 212*b*. The C channel 42 within the structural insulating core 111 extends through the bottom 212*b* of the one piece mold 212 securing the C channel 42 into the one piece mold 212. The one piece mold 212 can be of a rigid insulation, aerated autoclaved concrete or a rigid board material. Depending on the material used to form the one piece mold 212, the same material can also be used for the structural insulating core 111. A connector is shown as a twist connector channel 225 or a twist connector 220 in FIGS. 41 & 43A as an additional support between the two sides 212*a* of the beam mold 90 as well as a groove 121 or a dovetail joint 213 shown in the connector web 64*d* of the connector. The beam mold 90 can also be formed as two pieces with connectors attached to both sides 212A and the connector attached to the support channel shown here as a C channel 42 or within the groove 121 within the sides 212A.

Figure 42:
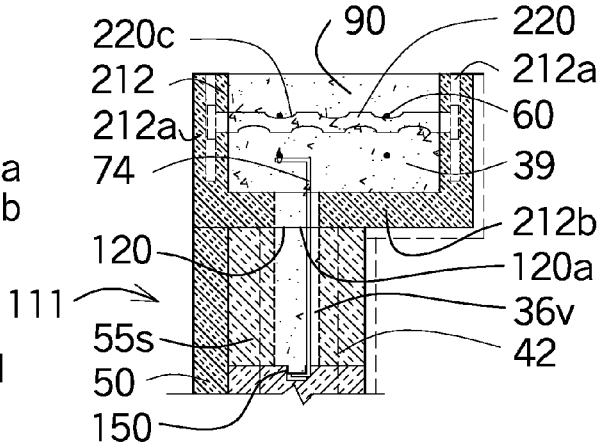
FIG. 42 shows a wide one piece beam mold where the C channel connects to a base plate and anchor bolts secure the beam mold to the structural insulating core.

FIGS. 40 & 42 are similar because the same rigid board 50 is attached to the structural insulating core 111 and the beam mold 90. Not all rigid boards have similar insulating properties, and therefore must be distinguished to be of different materials. FIG. 42 is a wall section showing the structural insulating core 111 with the rigid board 50 attached. The rigid board 50 can either be glued to the structural insulating core 111 or attached with fasteners (not shown) to the C channels 42. The beam mold 90 can be formed as one piece mold 212 having 2 sides 212*a* and a bottom 212*b*. The one piece mold 212 can be of the same material as the rigid board 50. A base plate 120 can be installed over the structural insulating core 111 so an anchor bolt 74 can be installed through the web 120*a* into the beam mold 90. Concrete 39 and reinforcing steel 60 are installed within the beam mold 90. A twist connector 220 can be used to support the 2 sides 212*a* of the beam mold 90 in FIGS. 10 and 42. The twist connector 220 is shown in more detail in FIGS. 43B & 43C. The smaller spacer insulation 55*s* is shown below the beam mold 90 with a vertical hole 36*v* and an anchor bolt 74 that attaches the horizontal bracing channel 150 to the reinforcing steel 60 within the beam mold 90.

Figure 43A:
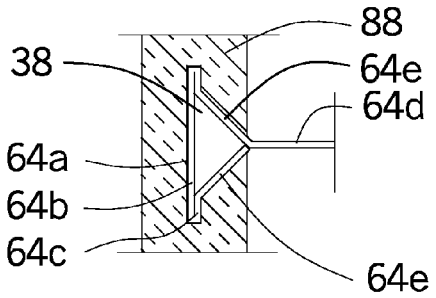

FIG. 43A shows an enlarged plan section of the end of a connector installed within a rigid board 50 or rigid block faces 88 and the connectors shown in FIGS. 41 & 42. Typically most ICF block molds 96 (not shown) have the connector embedded within the rigid foam block faces 88 and are molded within the rigid foam block faces 88 during the manufacturing process. The rigid foam block faces 88 that are not molded but are cut after the product has cured are cut or sliced like bread into thin rigid foam block faces 88 like aerated autoclave concrete and other rigid products. After the rigid foam block faces 88 are cut into slabs, the rigid foam block faces 88 need to be cut or routed to form a dove tail shape 213 shown in FIGS. 43B & 43C or an inverted V shape 64*a* into which a connector end 64*b* can be slid into the inverted V shape 64*a* into each of the rigid foam block faces 88 shown in FIG. 43A in the sides of 210*a*. The inverted V shape 64*a* can be of any shape as long as there is sufficient friction on the connector end 64*b* from being pulled from the inverted V shape 64*a* within the rigid foam block faces 88. Also shown in FIG. 43A is an extended leg 64*c* of the connector. The extended leg 64*c* is shown to add additional resistance and strength to the holding capacity of the connector. The connector web 64*d* can be a short bracket as shown in FIG. 41 or a like a full height web 44*a* of the bent flange channel 44 in FIG. 32. The connector web 64*d* can have holes 36 or grooves 121 to install reinforcing steel 60 within the one piece beam mold 210. The length of the connector will vary depending if the rigid foam block faces 88 are placed in a vertical or horizontal position. The rigid board 50 or rigid insulation 51 shown in FIG. 25 can be interchanged to be the rigid foam block faces 88. In addition, the connector can be of rigid plastic as well as metal as described earlier. The connector as described has a cavity 38 similar to the cavity 38 of the bent flange channel 44 in FIG. 25. The inverted V shape 64*a* conforms to the two sides 64*e*, the extend leg 64*c* and the connector end 64*b* of the connector.

Figure 43B:
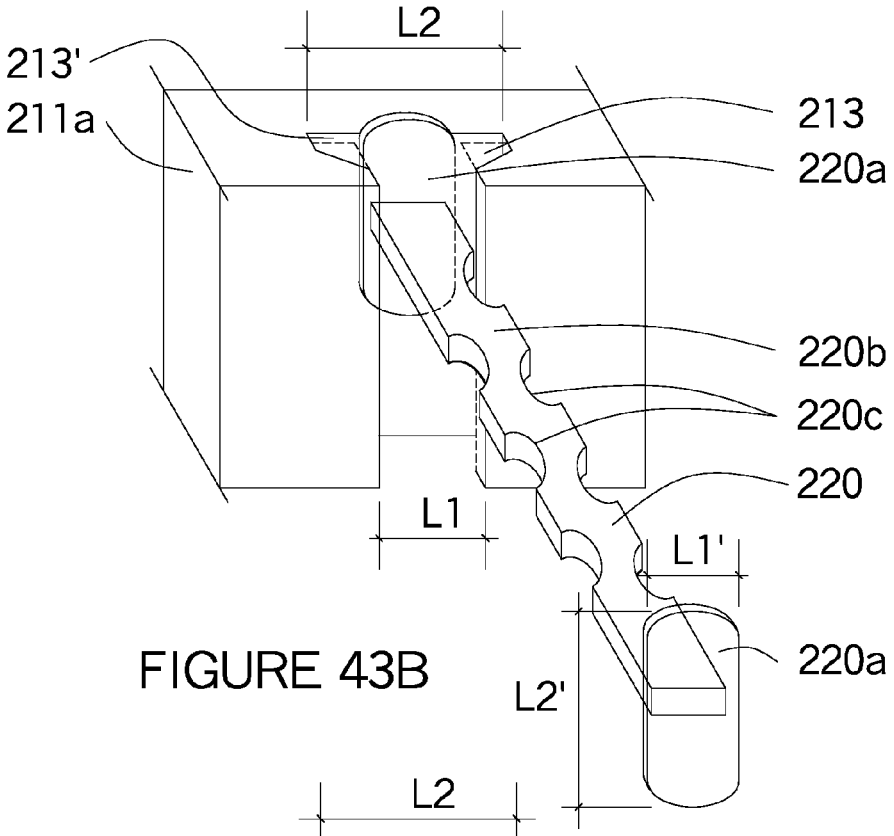
FIG. 43B shows a twist connector being inserted into a dovetail joint in the side wall of an ICF mold.
Figure 43C:
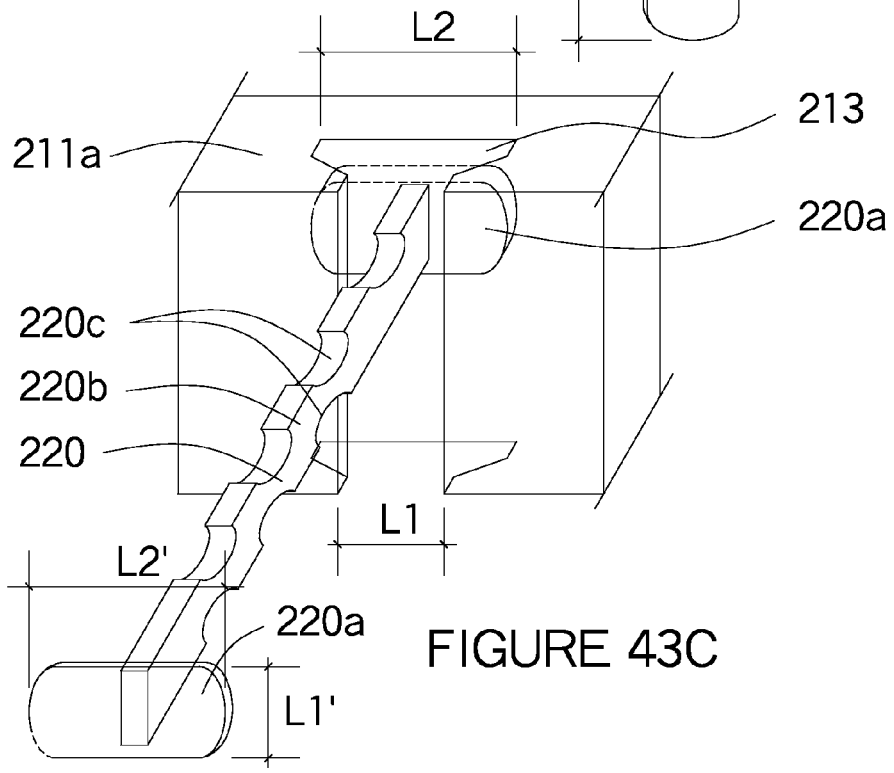
FIG. 43C shown a twist connector locked into position of a dovetail joint in the side wall of an ICF mold.

FIG. 43B and FIG. 43C show the twist connector 220 in an inserting position FIG. 43B and the fixed position 43C. As stated earlier, the twist connector 220 is shown installed in the beam mold 90 in FIG. 42 however any of the rigid foam block faces 88 as described earlier can also be used. The side wall 210*a* is also shown in FIGS. 43B & 43C with a dovetail joint 213 shown within each half of the side wall 210*a*. The dovetail joint 213 is similar to the invert V shaped 64*a* shown in FIG. 43A; however the dovetail joint 213 has a wide opening at the interior side shown as L1 and a wider opening within the middle of the side wall 210*a* shown as L2. The twist connector 220 shown in FIGS. 43B & 43C has two connector heads 220*a* connected by a connector shaft 220*b*. The connector heads 220*a* are shown having a narrow width L1' with a longer length of L2'. FIG. 43B shows the connector head 220*a* shown in a vertical position; where the smaller connector head L1' is inserted through the interior side L1 of the dovetail joint 213. The connector head 220*a* is then turned or twisted 90 degrees within the dovetail joint 213, so that the long length L2' of the twist connector 220 is turned the full width L2 of the dovetail joint 213. When the twist connector 220 is turned 90 degrees within the dovetail joint 213, the twist connector 220 is locked into position within the side wall 211*a*. The twist connector shaft 220*b* is rectilinear in shape and when the twist connector 220 is in the locked position, the twist connector shaft has a rebar depression 220*c* so steel reinforcing (not shown) can be installed in the rebar depressions 220*c* as shown in FIG. 42.

FIG. 44 and FIG. 45 shows various flange extensions added to the U channel 41 and the C channel 42 previously shown as bent flange channel 44 in FIG. 28, as a double flange channel 105 in FIG. 36. In FIG. 44 the flange extension 200 is shown attached to the U channel 41 at 200*a*, then bent at 200*b* around the flange 41*b* of the U channel 41 and continues at an angle to the web 41*a* forming a cavity 38. Another flange extension 201 is similar to flange extension 200 except a portion of the flange extension at 201*a*' has two extra bends in form a flange depression 201*a*" when drywall (shown is ghost) is applied of the flange extension 201*a*'. The flange extension 202 is attached to the U channel 41 at 202*a*, then bent at 202*b* around the flange 41*b*, however a gap 202*b*' is formed between the flange 41*b* and the continuation of the flange extension 202 at 202*c*. The gap 202*b*' is formed so as to install a foam spacer 55 not shown between the flange 41*b* and the flange extension 202*c*.

In FIG. 45 has a flange extension 203 that is installed by friction rather than a fastener 37 as shown in FIG. 44. The flange extension 203 has one leg 203*a* that rests against the lip 42*c* and the other leg 203*b* rests against the web 42*a* of the C channel 42. The leg 203*b* is at an angle to the web 42*b* similar to the flange extension 200. When the leg 203*a* fits against the lip 42*c* and other leg 203*b* rest against the web 42*a*, friction against the leg 203*b* to the web 42*b* holds the loose flange extension 203 in place. The flange extension 204 is shown as a rectangular tubular shape, however the flange extension 204 can be a "C" so as not to allow concrete to flow into the flange extension 204 as shown as a spacer in FIG. 40. The flange extensions 200, 201, 202 & 203 can be short brackets or full length depending on the height of the wall and can be manufactured of plastic or metal. The flange extensions 200, 201, 201 & 203 are attached to the U channel 41 or C channels 42 when embedded into any of the previous described concrete molds in order to have a cavity 38 into which drywall (not shown) can be installed into the concrete molds.

CONCLUSION AND SCOPE OF INVENTION

The wall panel having a structural insulating core as a wall mold of structural support members and spacer blocks (also referred to as foam spacer and spacer insulation) that fit between the structural support members along with connectors attached to the support channels and concrete. The foam spacers are thermal blocks that are wider than the support members that interlock between other foam spacers and structural support members which when assembled together form a wall panel. Many types of support members such as metal channels can fit between the support members and interlock together with a tongue and groove connections both vertically and horizontally. Horizontal bracing channels interlock between the support members, and spacer blocks, along with the horizontal tongue and trough connects that interlock the spacer blocks together. The tongue and groove connections allow the spacer blocks to just slide together without fasteners or mortar to hold them in place. When the structural insulating core is placed horizontally, concrete is placed into the wall mold and into any additional rib molds, column molds, beam molds, or ribs and grooves that were added.

A structural insulating core where the thickness can vary the shape and function of the concrete molds. The concrete molds can be poured face up or face down into a forming bed. Different recesses or grooves can be installed as accents on the spacer blocks or within the concrete facing.

A structural insulating core where rib, column or beam molds are used to increase the strength of the concrete poured over the wall mold to form a concrete flooring system.

A structural insulating core having support channels with insulating foam wraps at one side or both sides prior to concrete installed within the concrete molds.

It is understood that the invention is not to be limited to the exact details of operation or structures shown and describing in the specification and drawings, since obvious modifications and equivalents will be readily apparent to those skilled in the art. The flexibility of the described invention is very versatile and can be used in many different types of building applications.

The invention claimed is:

1. A concrete wall panel mold for a building having a structural insulation core of support members and spacer blocks along with connectors forming a wall comprising:

spaced apart vertically oriented metal support channels with holes located in a channel web, spacer blocks positioned between and at least spanning the distance between the channels, a block depth dimension being substantially greater than the distance between channel flanges, a vertical groove and corresponding transverse mating tongue fully extending along a transverse length of facing, opposed side block surfaces, the groove and tongue surfaces contacting and projecting fully past channel flange, a base angle groove running perpendicular to the vertical tongue and groove, the base angle groove in the upper face of a top block or lower face of a bottom block face and positioned from a front or a back block surface a dimension equal to a foam thickness from the front or the back, respectively, of the block to the channel flange, a connector that connects the side block surfaces attaching to the flanges of the metal support and remains partially exposed above the side block surfaces, a base plate having flanges inserted in grooves cut in the blocks; the base plate flanges secured to the channel flanges of the support channels, and a forming bed defining the thickness, height and width of the wall mold into which concrete is poured under or over the structural insulating, after which a cured concrete wall panel is erected vertically and secured to a floor.

2. The concrete wall panel mold of claim 1 further comprising:

spaced apart horizontally oriented metal support channels with holes, horizontal bracing channels fitting into the holes of the support channels, spacer blocks positioned between and at least spanning the distance between the channels, the blocks consisting of:

a block depth dimension being substantially greater than the distance between channel flanges, a groove and a transverse mating tongue fully extending along a transverse length of facing, opposed side block surfaces, the groove and tongue surfaces contacting and encompassing the two channel flanges, a trough and horizontal tongue fitting together and aligned with holes in support channels.

3. The concrete wall panel mold of claim 2 wherein the spacer block has a tongue side fitting against the web and flanges of the support channels with a block face having an indentation and the opposed block face has a projection and extension over the support channel; the groove side fits against the web on the support channel with a block face having an indentation and the opposed block face having a projection and extension of the support channel; and where block face has an indentation and a projection and extension.

4. The concrete wall panel mold of claim 1 wherein the structural insulating core has depressions in the face of the spacer blocks to form additional beam, column or rib molds within the precast mold.

5. The concrete wall panel mold of claim 4 wherein the column mold is formed between two structural insulating cores walls when the sides of each structural insulating foam core walls has a support channel and the spacer block overlaps one flange of each spacer block forming the bottom of the column mold with the support channels forming the sides of the column mold.

6. The concrete wall panel mold of claim 1 wherein the connectors in the structural insulating core can be screws or double headed screws that are exposed above the space blocks and are attached through the projection of the spacer blocks into the flange of the support channel securing the spacer blocks together.

7. The concrete wall panel mold of claim 1 wherein the structural insulating core walls are placed face down, suspended above a forming bed, the structural insulated core walls has holes in the spacer blocks for concrete to flow through the rib, column or beam molds and into the forming bed.

8. The concrete wall panel mold of claim 1 wherein concrete does not have to be installed over the entire surface of the structural insulating core precast concrete panels but only at the ribs, columns and beams.

* * * * *